US008634751B2

(12) United States Patent
Moteki et al.

(10) Patent No.: US 8,634,751 B2
(45) Date of Patent: Jan. 21, 2014

(54) IMAGE FORMING APPARATUS

(75) Inventors: Junichi Moteki, Abiko (JP); Hideaki Miyazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 13/247,202

(22) Filed: Sep. 28, 2011

(65) Prior Publication Data

US 2012/0087687 A1 Apr. 12, 2012

(30) Foreign Application Priority Data

Oct. 7, 2010 (JP) ..... 2010-227527
Oct. 7, 2010 (JP) ..... 2010-227528
Oct. 7, 2010 (JP) ..... 2010-227529

(51) Int. Cl.
*G03G 15/20* (2006.01)
*G03G 15/00* (2006.01)

(52) U.S. Cl.
USPC ..... 399/322; 399/400

(58) Field of Classification Search
USPC ..... 399/400, 322
See application file for complete search history.

(56) References Cited

U.S. PATENT DOCUMENTS 6,909,857 B2 * 6/2005 Tanaka ..... 399/45
2005/0169683 A1 * 8/2005 Tanaka ..... 399/400

FOREIGN PATENT DOCUMENTS

JP 04204582 A * 7/1992
JP 2004359386 A * 12/2004
JP 2006-251441 A 9/2006

* cited by examiner

*Primary Examiner* — Daniel J Colilla
*Assistant Examiner* — John M Royston
(74) *Attorney, Agent, or Firm* — Canon USA, Inc., IP Division

(57) ABSTRACT

An image forming apparatus may include a transfer nip, a first conveyance belt, a second conveyance belt, a fixing nip, a fixing drive unit, and a control unit. The first conveyance belt conveys the sheet to which a toner image is transferred and fixed. The fixing drive unit drives the fixing nip so that the fixing nip conveys the sheet at a speed that is higher than the transfer speed in a high speed fixing mode in which the fixing nip fixes the toner image to the sheet while conveying the sheet. The control unit sets a circumferential speed of the first conveyance belt and a circumferential speed of the second conveyance belt so that the sheet bridging the first and second conveyance belts is pulled by the second conveyance belt to slide on the first conveyance belt in the high speed fixing mode.

22 Claims, 21 Drawing Sheets

FIG. 4

| MODE | TYPE | GRAMMAGE (gsm) | FIXING SPEED VF (mm/sec) |
|---|---|---|---|
| 1 | COATED PAPER | 50 ~ 70 | 480 |
| | PLAIN PAPER | 70 ~ 80 | |
| 2 | COATED PAPER | 71 ~ 100 | 420 |
| | PLAIN PAPER | 81 ~ 100 | |
| 3 | COATED PAPER | 101 ~ 150 | 360 |
| | PLAIN PAPER | 101 ~ 130 | |
| 4 | COATED PAPER | 151 ~ 300 | 300 |
| | PLAIN PAPER | 131 ~ 300 | |

IMAGE FORMING APPARATUS

BACKGROUND OF THE INVENTION

1. Field of the Invention

The present invention relates to an image forming apparatus which forms an image on a sheet.

2. Description of the Related Art

Heretofore, there has been known an image forming apparatus in which a toner image formed on an image bearing member, such as a photosensitive member or an intermediate transfer member, is transferred onto a sheet by a transfer unit and the toner image transferred onto the sheet is heated and fixed by a fixing unit.

The fixing unit applies heat which is suited for melting and fixing the toner onto the sheet in the fixing unit. The quality of heat varies according to the kind of the sheet. According, an apparatus changes the conveyance speed of a sheet in a fixing unit according to the kind of a sheet, which changes the quantity of heat applied to the sheet according to the kind of the sheet.

Japanese Patent Application Laid-Open No. 2006-251441 discusses an image forming apparatus which makes faster the conveyance speed of a sheet in a fixing unit than in a transfer unit in a case where the sheet is plain paper (whose thickness is normal). The image forming apparatus arranges two conveyance belts side by side in the conveyance direction between the transfer and fixing units. The two conveyance belts convey the sheet while sucking the sheet to convey the sheet holding the toner yet to be fixed to the fixing unit. Each length of the two conveyance belts in the direction in which the sheet is conveyed is longer than the maximum length of a usable sheet. In a configuration described in Japanese Patent Application Laid-Open No. 2006-251441, the sheet is conveyed as described below.

The sheet sent out from the transfer unit is received by an upstream conveyance belt driven at a conveyance speed in the transfer unit and the upstream conveyance belt conveys the sheet to a downstream conveyance belt similarly driven at the conveyance speed in the transfer unit. Before the leading edge of the sheet reaches the fixing unit and when the trailing edge of the sheet reaches the downstream conveyance belt, the conveyance speed of the downstream conveyance belt is changed to a fixing speed. The downstream conveyance belt driven at the fixing speed conveys the sheet to the fixing unit.

More specifically, the length of the downstream conveyance belt in the sheet conveyance direction is longer than the maximum length of the usable sheet, which sometimes carries and conveys the sheet only by the downstream conveyance belt, and, at this point, the conveyance speed of the downstream conveyance belt is changed to the fixing speed. In the above image forming apparatus, however, when the trailing edge of the sheet to be conveyed reaches the downstream conveyance belt, the conveyance speed of the downstream conveyance belt is changed to a high fixing speed. In other words, the sheet is conveyed at a low transfer speed until the trailing edge of the sheet to be conveyed moves away from the upstream conveyance belt. This delays the timing at which the conveyance speed of the sheet is changed to the high fixing speed. The timing at which the speed of the sheet advancing from the transfer unit is changed to the high speed is slow, taking the sheet advancing from the transfer unit longtime to reach the fixing unit, which lowers productivity.

SUMMARY OF THE INVENTION

The present invention is directed to increasing productivity by shortening the time until a sheet advancing from a transfer unit reaches a fixing unit in an image forming apparatus capable of forming an image on a sheet with a fixing speed made higher than a transfer speed.

According to an aspect of the present invention, an image forming apparatus includes a transfer nip configured to transfer a toner image to a sheet conveyed at a transfer speed, a first conveyance belt configured to convey the sheet to which the toner image is transferred at the transfer nip, a second conveyance belt provided downstream of the first conveyance belt in a conveyance direction in which the sheet is conveyed and configured to convey the sheet, a fixing nip provided downstream of the second conveyance belt in the conveyance direction and configured to fix the toner image to the sheet while conveying the sheet, a fixing drive unit configured to drive the fixing nip so that the fixing nip conveys the sheet at a speed that is higher than the transfer speed in a high speed fixing mode in which the fixing nip fixes the toner image to the sheet while conveying the sheet at the speed that is higher than the transfer speed, and a control unit configured to set a circumferential speed of the first conveyance belt to a first speed at which the sheet advances from the transfer nip and a circumferential speed of the second conveyance belt to a second speed at which a leading edge of the sheet enters the fixing nip and which is higher than the first speed so that the sheet bridging the first and second conveyance belts is pulled by the second conveyance belt to slide on the first conveyance belt in the high speed fixing mode.

According to an exemplary embodiment of the present invention, productivity can be increased in an image forming apparatus capable of forming an image on a sheet with a fixing speed made higher than a transfer speed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a table indicating a relationship among fixing speed, type, and grammage of a sheet.

DESCRIPTION OF THE EMBODIMENTS

Various exemplary embodiments, features, and aspects of the invention will be described in detail below with reference to the drawings.

Figure 1:
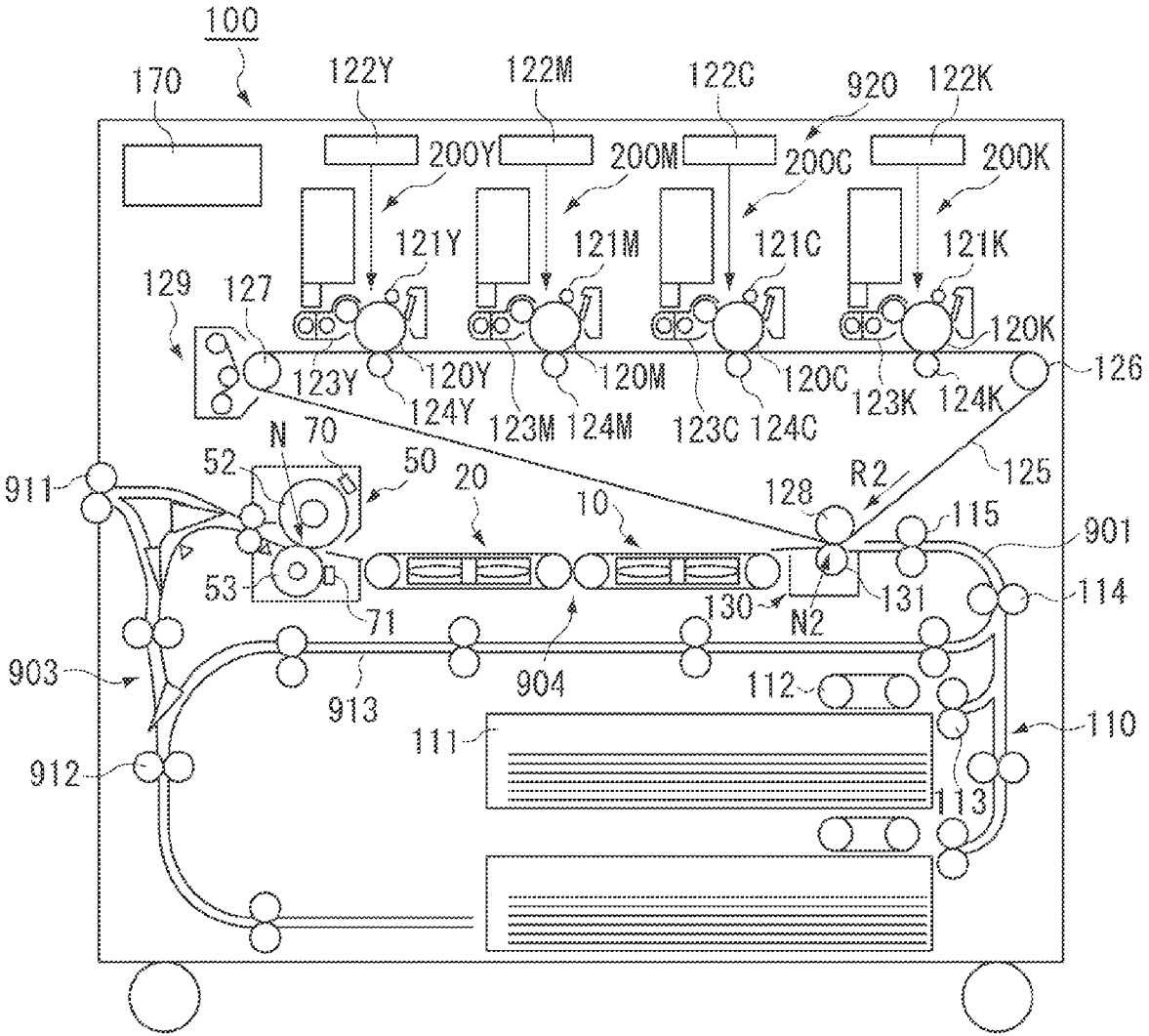
FIG. 1 illustrates a schematic diagram of an image forming apparatus according to a first exemplary embodiment.

FIG. 1 is a cross section illustrating a general configuration of an image forming apparatus according to a first exemplary embodiment.

An image forming apparatus 100 includes a feeding unit 110 for feeding a stored sheet, an image forming unit 920 for forming a toner image on the sheet fed by the feeding unit 110, and a belt conveyance unit 904 for conveying the sheet on which the toner image is formed to a fixing unit 50. The image forming apparatus 100 further includes a post conveyance unit 903 for conveying the sheet to which the toner image is fixed by the fixing unit 50.

The feeding unit 110 includes a sheet cassette 111 for storing sheets, a pickup roller 112 for picking up the sheet from the sheet cassette 111, and a separation device 113 for separating and feeding the sheet picked up by the pickup roller 112. The feeding unit 110 further includes a feeding roller 114 for conveying the sheet on a feeding path 901 along which the sheet separated and fed by the separation device 113 is conveyed and a registration roller 115.

The image forming unit 920 is a tandem image forming unit in which image forming stations 200Y, 200M, 200C, and 200K corresponding to yellow (Y), magenta (M), cyan (C), and black (K) respectively are arranged in series. Each of the image forming stations 200Y, 200M, 200C, and 200K includes a photosensitive drum 120, a primary charge device 121, an exposure device 122, and a development device 123.

The image forming unit 920 includes an intermediate transfer belt 125 to which the toner image visualized by the image forming stations 200Y, 200M, 200C, and 200K is transferred. The intermediate transfer belt 125 is stretched and supported by a drive roller 126, a tension roller 127, and a counter roller 128 and driven by the drive roller 126 to be rotated in the direction of an arrow R2.

Pressing a secondary transfer roller 131 against the intermediate transfer belt 125 supported by the counter roller 128 from the inside forms a secondary transfer nip N2 between the secondary transfer roller 131 and the intermediate transfer belt 125. A secondary transfer unit 130 is comprised of the secondary transfer roller 131, the intermediate transfer belt 125, and the counter roller 128. A belt cleaning device 129 rubs a cleaning web against the intermediate transfer belt 125 to remove a residual transfer toner and paper dust remaining on the surface of the intermediate transfer belt 125 passing through the secondary transfer nip N2.

The fixing unit 50 arranged more downstream than the secondary transfer unit 130 in the sheet conveyance direction fixes a toner image to the sheet by heat and pressure. The fixing unit 50 includes a heating roller 52, which incorporate a heater therein, and a pressure roller 53. The fixing unit 50 further includes a heating roller temperature sensor 70 for detecting the surface temperature of the heating roller 52 and a pressure roller temperature sensor 71 for detecting the surface temperature of the pressure roller 53. The heating roller temperature sensor 70 and the pressure roller temperature sensor 71 are provided to keep the surface temperature of the heating roller 52 and the pressure roller 53 at an appropriate level.

The belt conveyance unit 904 is arranged between the secondary transfer unit 130 and the fixing unit 50. The belt conveyance unit 904 is composed of a first belt conveyance unit 10 arranged upstream in the conveyance direction and a second belt conveyance unit 20 arranged downstream. The configuration of the belt conveyance unit 904 is described in detail below.

The post conveyance unit 903 includes a discharge roller 911 for discharging the sheet discharged from the fixing unit 50 outside the apparatus. The post conveyance unit 903 further includes a reversing roller 912 for reversing and conveying the sheet and a two-sided conveyance path 913 which conveys the sheet reversed by the reversing unit and is merged into the feeding path 901 on the downstream side.

Operation related to image formation in the image forming apparatus 100 is roughly described below.

The exposure device 122 exposes the photosensitive drum 120 to form an electrostatic latent image on the photosensitive drum 120. The electrostatic latent image on the photosensitive drum 120 is developed by the development device 123 and visualized as a toner image.

The toner image carried on the surface of the photosensitive drum 120 is sequentially superimposed on the intermediate transfer belt 125, which is referred to as a primary transfer. The toner image on the intermediate transfer belt 125 to which all colors of Y, M, C, and K are primary-transferred is secondary-transferred to a sheet S fed by the feeding unit 110 at the secondary transfer nip N2. The intermediate transfer belt 125 is rotatably driven by the drive roller 126 rotating at a constant speed and the circumferential speed thereof is kept at a constant transfer speed. The sheet to which the toner image is transferred is conveyed by the secondary transfer nip N2 at the transfer speed. In the present exemplary embodiment, the transfer speed is set to 300 mm/sec. The transfer speed refers to the speed of a sheet at the time of transferring the toner image.

The registration roller 115 of the feeding unit 110 receives the sheet S in a stop state, puts the sheet S on standby, and sends out the sheet S to the secondary transfer nip N2 in timed relationship with the toner image on the intermediate transfer belt 125.

The sheet S carrying the toner image transferred at the secondary transfer nip N2 is conveyed to the fixing unit 50 by the belt conveyance unit 904. In the fixing unit 50, a fixing nip N nips the sheet S, and the application of heat and pressure to the toner image yet to be fixed fixes the toner image to the sheet. The sheet subjected to the fixing process and sent out from the fixing unit 50 is discharged outside the apparatus by the discharge roller 911.

In a case where an image is formed on two sides, the sheet sent out from the fixing unit 50 is transferred to the reversing roller 912, reversed by the reversing roller 912, and then guided to the feeding path 901 via the two-sided conveyance path 913. The toner image is formed on the other side of the sheet as is the case with the one side thereof.

Figure 2:
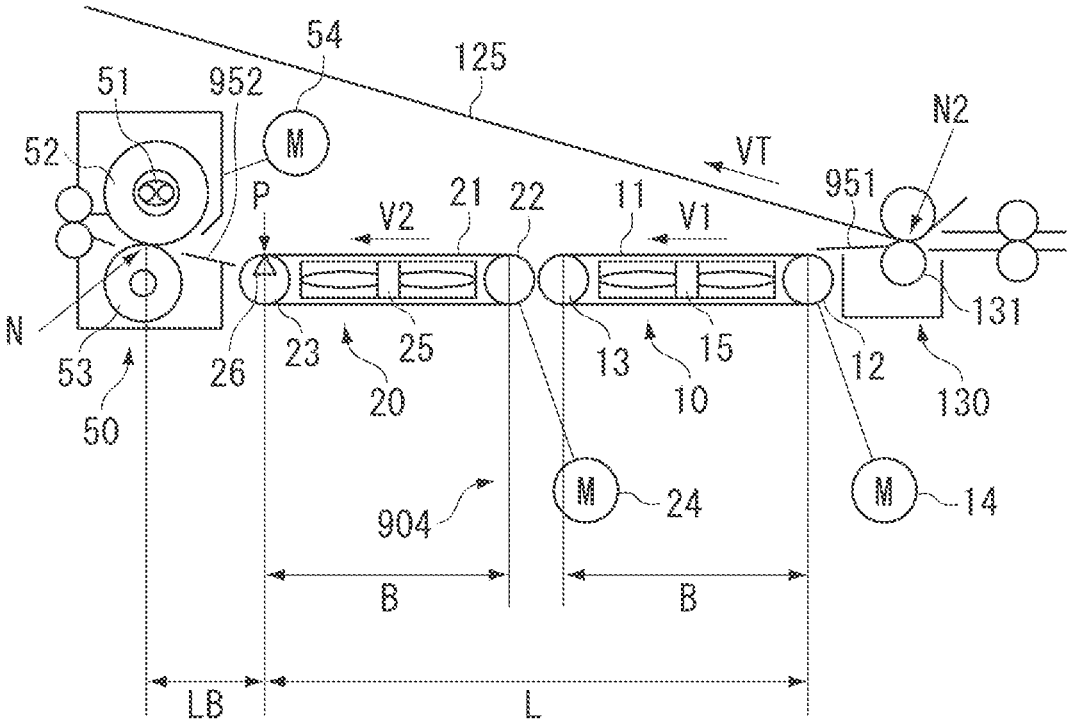
FIG. 2 is an enlarged view between a secondary transfer unit and a fixing unit in the first exemplary embodiment.
Figure 3:
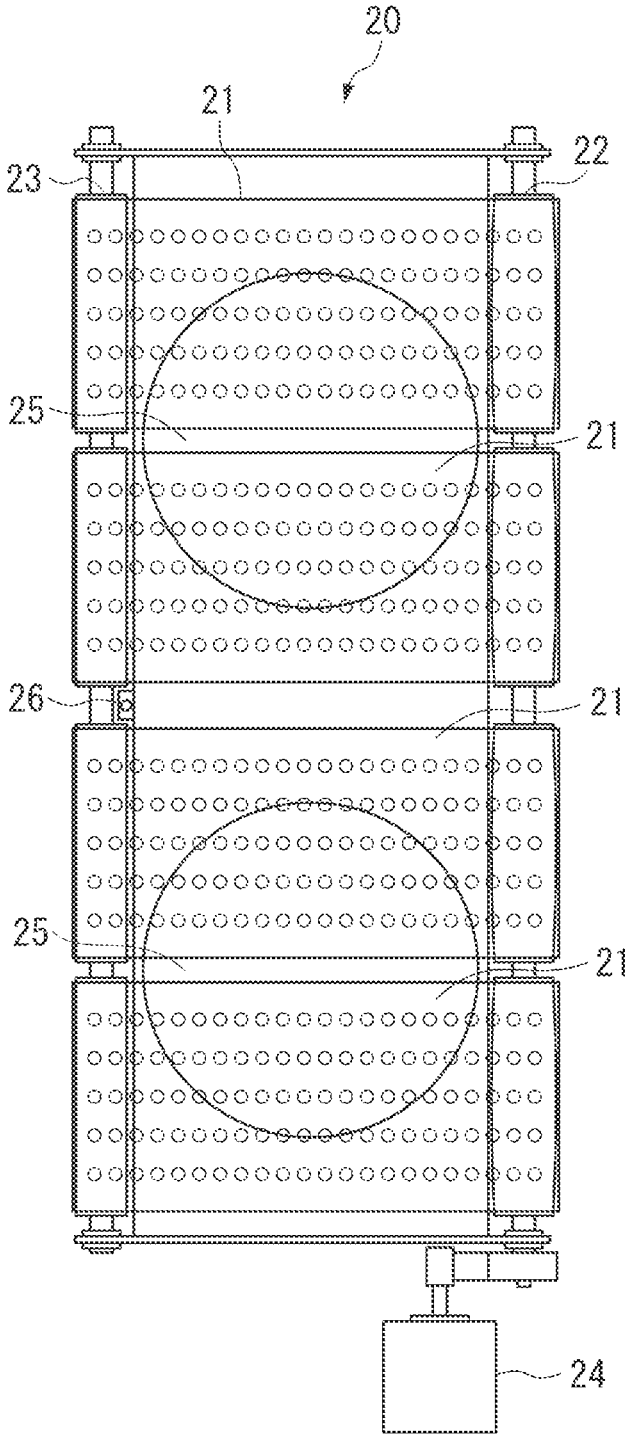
FIG. 3 is a top view of a second conveyance belt unit in the first exemplary embodiment.

The detailed configuration of the belt conveyance unit 904 and its periphery is described below using FIG. 2, which is an enlarged view illustrating the secondary transfer unit 130, the belt conveyance unit 904, and the fixing unit 50, and FIG. 3, which is a top view of the belt conveyance unit 904.

The belt conveyance unit 904 includes the first belt conveyance unit 10 arranged more downstream than the secondary transfer nip N2 in the sheet conveyance direction and the second belt conveyance unit 20 arranged on the downstream side of the first belt conveyance unit 10 and more upstream than the fixing nip N.

A transfer guide 951 for guiding the sheet advancing from the secondary transfer nip N2 to the belt conveyance unit 904 is provided between the belt conveyance unit 904 and the secondary transfer nip N2. A pre-fixing guide 952 for guiding the sheet conveyed by the belt conveyance unit 904 to the fixing nip N is provided between the belt conveyance unit 904 and the fixing nip N.

The first belt conveyance unit 10 includes a first endless conveyance belt 11 provided with a large number of holes, a first drive roller 12, and a driven roller 13, between which the first endless conveyance belt 11 is stretched. The first belt conveyance unit 10 includes a first conveyance belt drive motor 14 for rotating the first conveyance belt 11 via the first drive roller 12. Inside the first conveyance belt 11 is arranged a first suction fan 15 as a first suction device which attracts the sheet conveyed by the first conveyance belt 11 on the circumferential surface of the first conveyance belt 11 via a large number of holes formed in the first conveyance belt 11. In other words, the first suction fan 15 sucks air from the upper surface side of the first conveyance belt 11 to attract the conveyed sheet on the upper surface of the first conveyance belt 11. The first conveyance belt drive motor 14 performs drive so that the circumferential speed V1 of the first conveyance belt 11 (hereinafter referred to as a conveyance speed V1 of the first belt conveyance unit 10) becomes equal to 300 mm/sec, which is the same speed as the transfer speed VT.

The second belt conveyance unit 20 is substantially similar in configuration to the first belt conveyance unit 10. The second belt conveyance unit 20 includes a second endless conveyance belt 21 provided with a large number of holes as illustrated in FIG. 3, a second drive roller 22, and a driven roller 23, between which the second conveyance belt 21 is stretched. The second belt conveyance unit 20 further includes a second conveyance belt drive motor 24 for rotating the second conveyance belt 21 via the second drive roller 22. Inside the second conveyance belt 21 is arranged a second suction fan 25 as a second suction device which attracts the sheet conveyed by the second conveyance belt 21 on the circumferential surface of the second conveyance belt 21 via a large number of holes formed in the second conveyance belt 21. In other words, the second suction fan 25 sucks air from the upper surface side of the second conveyance belt 21 to attract the conveyed sheet on the upper surface of the second conveyance belt 21. The second conveyance belt drive motor 24 can change the circumferential speed V2 of the second conveyance belt 21 (hereinafter referred to as a conveyance speed V2 of the second belt conveyance unit 20).

On the side of the fixing unit 50 in the second conveyance belt 21 is provided a sheet leading edge detection sensor 26 for detecting the leading edge of a sheet in a detection position P that is more upstream than the fixing nip N. The detection position P where the sheet leading edge detection sensor 26 detects a sheet is set to such a position that the trailing edge of the sheet passes the secondary transfer nip N2 when the leading edge of the sheet reaches the detection position P. In the present exemplary embodiment, the distance between the secondary transfer nip N2 and the detection position P is set longer than the length L of the longest sheet S (hereinafter referred to as the length of the maximum sheet) in the conveyance direction which can be used by the image forming apparatus. In the present exemplary embodiment, the detection position P where the sheet leading edge detection sensor 26 detects a sheet is set to the downstream end of the second conveyance belt 21.

In the fixing unit 50, the heating roller 52 is rotatably driven by a heating roller drive motor 54 (a DC brushless motor, for example) as a fixing drive unit. The circumferential speed of the heating roller 52 (hereinafter referred to as a fixing speed VF) can be changed. The fixing speed refers to the speed of a sheet at which the sheet to which the toner image is fixed by the fixing unit 50 is conveyed. The sheet S conveyed by the fixing nip N formed between the heating roller 52 and the pressure roller 53 is conveyed at the fixing speed VF.

The length of a sheet conveyance path between the secondary transfer nip N2 and the fixing nip N is set longer than the length L of the maximum sheet. The length LB of the sheet conveyance path between the sheet leading edge detection sensor 26 and the fixing nip N is set longer than a distance required for changing the speed of the second conveyance belt 21.

The length B of the first and second conveyance belts 11 and 21 is equal to each other in the direction in which the sheet S is conveyed and somewhat shorter than the half of the length L of the maximum sheet. In the present exemplary embodiment, the first and second conveyance belts 11 and 21 are similar in configuration to use common components. However, the present invention is not limited to the first and second conveyance belts 11 and 21 being equal to each other in length (being similar in configuration). For example, the length of the first conveyance belt 11 in the conveyance direction may be taken as ⅔ of the length L of the maximum sheet and the length of the second conveyance belt 21 in the conveyance direction may be taken as ⅓ of the length L of the maximum sheet.

Figure 5:
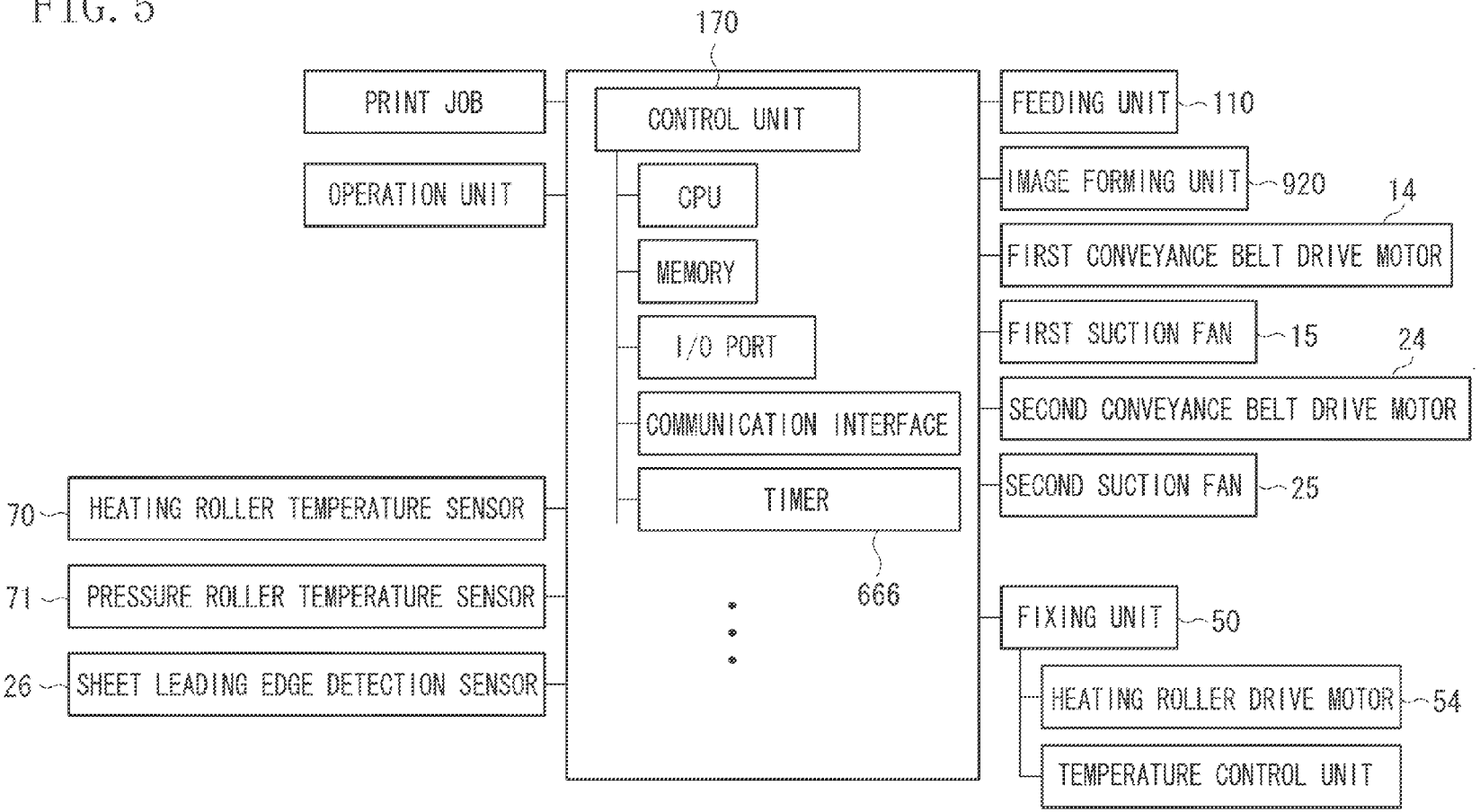
FIG. 5 is a block diagram illustrating the control unit of the image forming apparatus according to the first exemplary embodiment.

FIG. 5 is a block diagram illustrating the control of the image forming apparatus 100. A control unit 170 is comprised of an arithmetic processing unit including a central processing unit (CPU) and a memory and a circuit for transferring data with the outside such as an input/output (I/O) port and a communication interface. The control unit 170 controls the operation of the image forming apparatus by sequentially executing a plurality of programs stored in a memory according to situations.

The control unit 170 controls each unit such as a feeding unit 110 and an image forming unit 920 according to a print job sent from an external device. An operation unit connected to the control unit 170 sends information about the type of a sheet (such as grammage, size, plain paper or coated paper) to the control unit 170. The information sent as the print job from the external device includes also the type of a sheet. The coated paper refers to a sheet coated with resin. A signal is input from the sheet leading edge detection sensor 26 to the control unit 170. The control unit 170 controls the operation of the first and second conveyance belt drive motors 14 and 24, the first and second suction fans 15 and 25, and the heating roller drive motor 54.

Signals are input from the heating roller temperature sensor 70 and the pressure roller temperature sensor 71 in the fixing unit 50 to the control unit 170. The control unit 170 also controls the temperature of the heating roller 52 and the pressure roller 53. The control unit 170 controls the energization of a heater provided inside the heating roller 52 via a temperature control unit based on the output of the heating roller temperature sensor 70 so that the surface temperature of the heating roller 52 can be kept at a preset temperature. The control unit 170 controls the energization of a heater provided inside the pressure roller 53 via the temperature control unit based on the output of the pressure roller temperature sensor 71 so that the surface temperature of the pressure roller 53 can be kept at a preset temperature. In the present exemplary embodiment, the control unit 170 controls temperature so that the surface temperature of the heating roller 52 can be kept at 170° C. and the surface temperature of the pressure roller 53 can be kept at 100° C.

The control unit 170 controls the operation of the heating roller drive motor 54 in the fixing unit 50 so that the fixing speed is varied according to the grammage and type (plain paper or coated paper) among the information about the type of a sheet. FIG. 4 is a table indicating correspondence among the type of the sheet S, the grammage thereof, and the set fixing speed VF. Quantity of heat with which the fixing unit 50 supplies the sheet per unit area of the sheet is greater in a mode 2 than in a mode 1. Quantity of heat with which the fixing unit 50 supplies the sheet per unit area of the sheet is greater in a mode 3 than in the mode 2. Quantity of heat with which the fixing unit 50 supplies the sheet per unit area of the sheet is greater in a mode 4 than in the mode 3.

As illustrated in FIG. 4, the fixing speed for plain paper with a grammage of approximately 60 gsm (grams per square meter) is set to 480 mm/sec, for example. The quantity of heat of plain paper with a grammage of approximately 60 gsm is smaller than that of plain paper with a grammage of approximately 200 gsm, for example. For this reason, in a case where an image is fixed to plain paper with a grammage of approximately 60 gsm, the fixing speed is set to 480 mm/sec which is faster than 300 mm/sec to which the fixing speed is set in a case where an image is fixed to plain paper with a grammage of approximately 200 gsm, thereby reducing time for which the sheet S passes the fixing nip N. This makes smaller the quantity of heat with which the fixing unit 50 supplies the sheet per unit area in a case where an image is fixed to plain paper with a grammage of approximately 60 gsm than in a case where an image is fixed to plain paper with a grammage of approximately 200 gsm.

The greater the grammage of the sheet, the greater the quantity of heat. Therefore, the greater the grammage of the sheet, the greater the quantity of heat required per unit area of the sheet for heating the sheet to the temperature at which the toner is fixed to the sheet. As illustrated in FIG. 4, the fixing speed is lowered according as the grammage increases to increase the quantity of heat supplied per unit area of the sheet. Greater quantity of heat is required for fixing an image per unit area of the sheet in coated paper than in plain paper, so that the fixing speed is varied depending on the plain paper or the coated paper, as illustrated in the table of FIG. 4.

The control unit 170 adjusts also the conveyance speed V2 of the second belt conveyance unit 20 within the range of 300 mm/sec to 480 mm/sec according to speed adjustment of the fixing speed VF. The conveyance speed V2 of the second belt conveyance unit 20 is adjusted by the control unit 170 controlling the second conveyance belt drive motor 24.

The control and operation of conveyance of the sheet from the secondary transfer nip N2 to the fixing unit 50 are described below with reference to flow charts in FIGS. 6 and 7 and operation charts in FIGS. 8A to 8D to FIGS. 10A and 10B illustrating the state of conveyance of the sheet.

Figure 6:
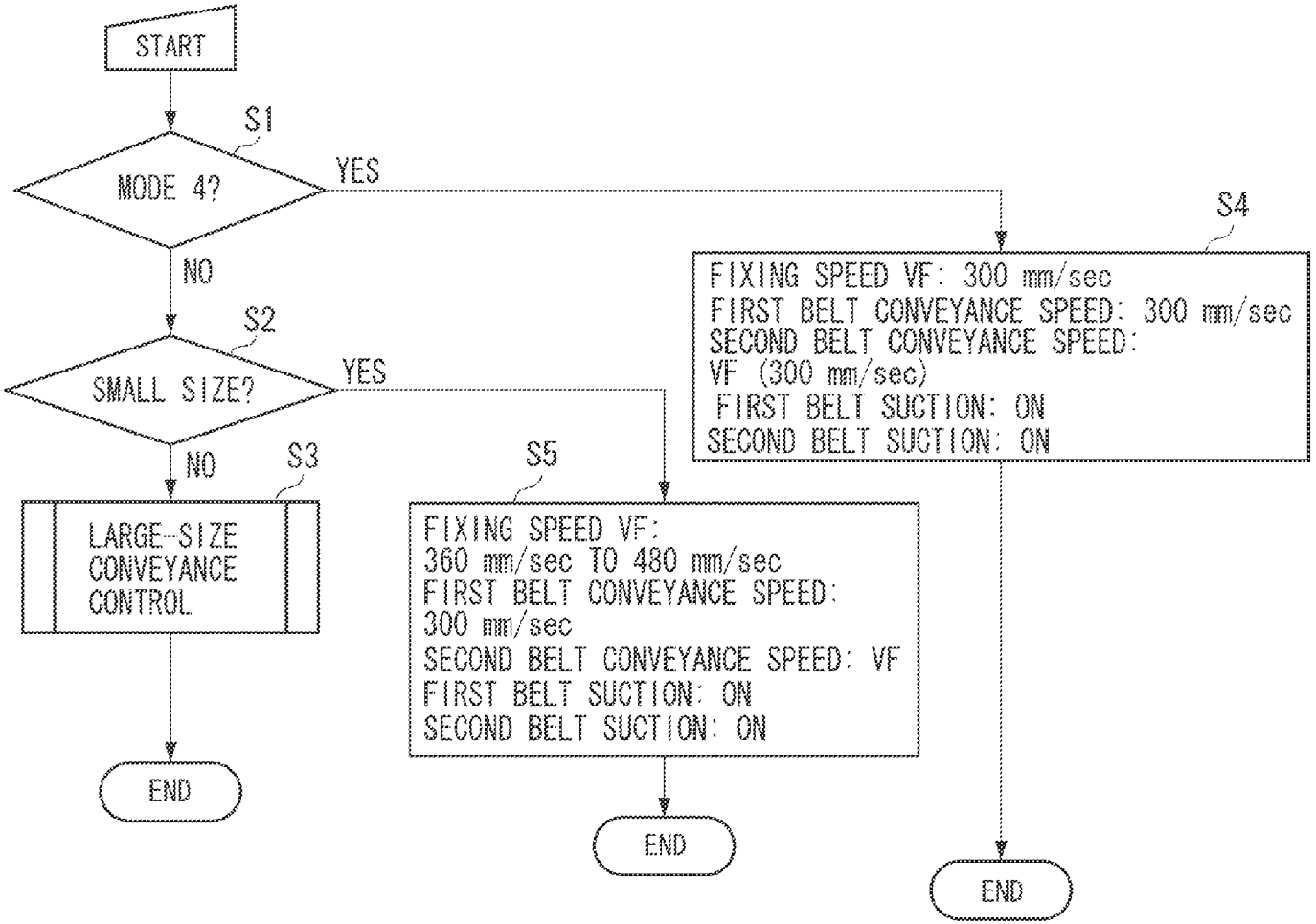
FIG. 6 is a flow chart illustrating the operation of the image forming apparatus according to the first exemplary embodiment.
Figure 7:
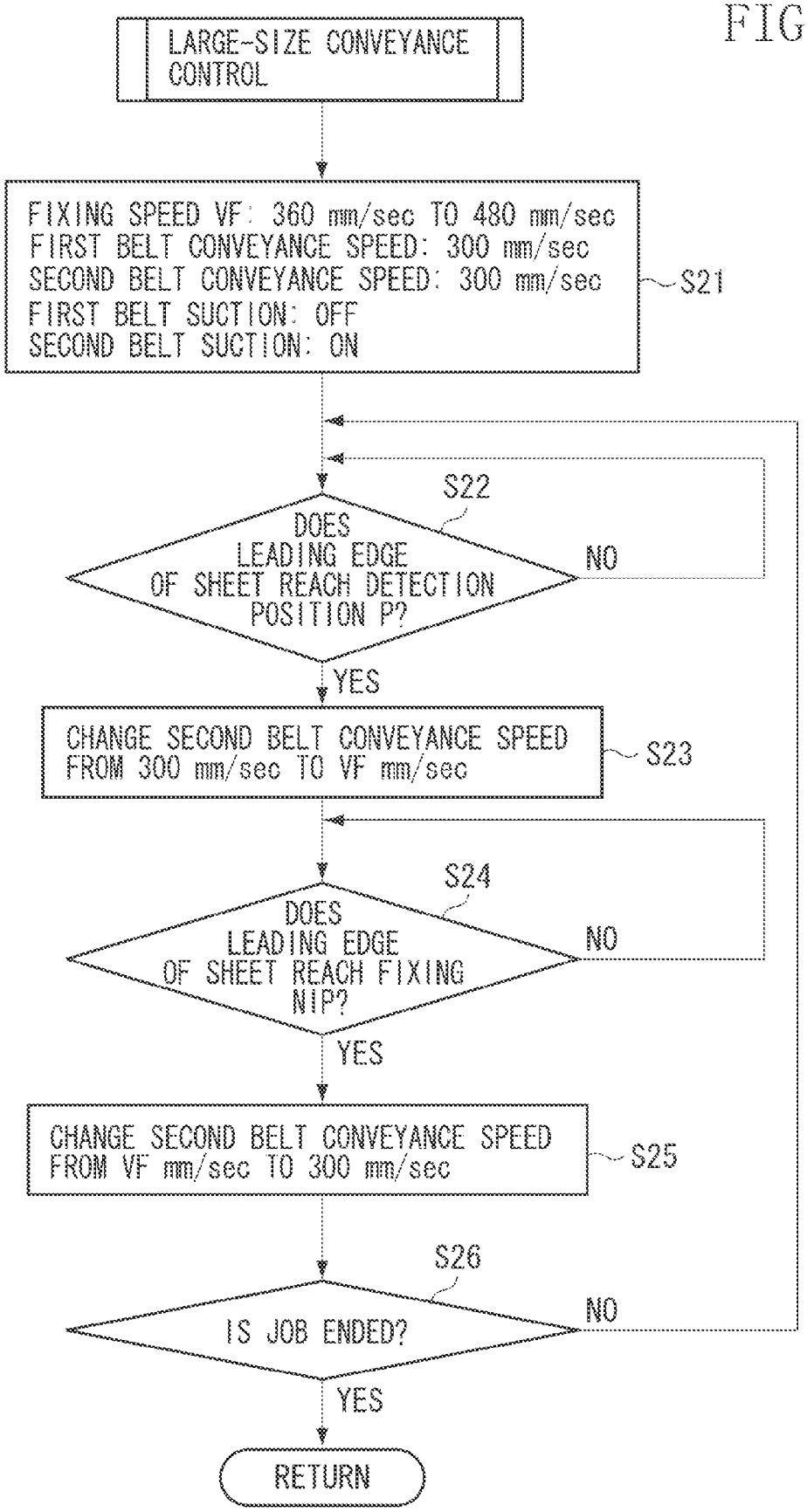
FIG. 7 is a flow chart illustrating a large-size conveyance control in the image forming apparatus according to the first exemplary embodiment.

In the flow chart in FIG. 6, the control unit 170 determines which the mode is in FIG. 4 based on the type and the grammage among the information about the sheet input from the operation unit. In step S1, the control unit 170 determines whether the transfer speed and the fixing speed are in the same mode (mode 4) with reference to the table in FIG. 4.

If the mode is not the mode 4 (the fixing speed is faster than the transfer speed) (NO in step S1), then in step S2, the control unit 170 determines whether the sheet is large or small in size based on size information among the information about the type of the sheet. In the present exemplary embodiment, the control unit 170 determines that the sheet is small in size in a case where the length of the sheet to be conveyed in the conveyance direction is shorter than the length from the secondary transfer nip N2 to the upstream end of the secondary transfer belt 21 and shorter than the length from the downstream end of the first transfer belt 11 to the fixing nip N. In step S2, if the control unit 170 determines that the sheet is not small in size, the control unit 170 executes a large-size conveyance control illustrated in FIG. 7. FIGS. 8A to 8D illustrate time-series charts illustrating the operation of conveyance of the sheet in performing the control in the mode in which the fixing speed is faster than the transfer speed and the size in which the size of the sheet is large (hereinafter referred to as a large-size conveyance control).

In the large-size conveyance control, in step S21, the control unit 170 controls the heating roller drive motor 54 to keep the fixing speed VF illustrated in FIG. 4 according to the type and the grammage of the sheet. The control unit 170 stops (OFF) the operation of the first suction fan 15 and rotates (ON) the second suction fan 25. The control unit 170 controls the first conveyance belt drive motor 14 so that the conveyance speed V1 of the first belt conveyance unit 10 becomes equal to 300 mm/sec which is equal to the transfer speed and is a first speed at which the sheet advancing from the transfer nip N2 is received. In step S21, the control unit 170 controls the second conveyance belt drive motor 24 so that the conveyance speed V2 of the second belt conveyance unit 20 becomes equal to 300 mm/sec which is equal to the transfer speed and is a first speed at which the sheet advancing from the transfer nip N2 is received.

It is exemplified herein that the first speed of the first and second belt conveyance units 10 and 20 at which the sheet advancing from the transfer nip N2 is received is equal to the transfer speed. However, the first speed of the first and second belt conveyance units 10 and 20 has only to be a speed at which the sheet advancing from the transfer nip N2 can be smoothly conveyed without significantly affecting the transfer of the toner image and does not always need to be equal to the transfer speed. For example, the first speed at which the sheet advancing from the transfer nip N2 is received may be speed which is faster by 4% than the transfer speed. This is because the sheet is conveyed with the sheet nipped with the transfer nip N2 to allow the sheet to be conveyed while sliding on the first and second conveyance belts 11 and 12. The first speed may be set to a speed which is somewhat slower than the transfer speed and little affects the transfer.

Figure 8A:
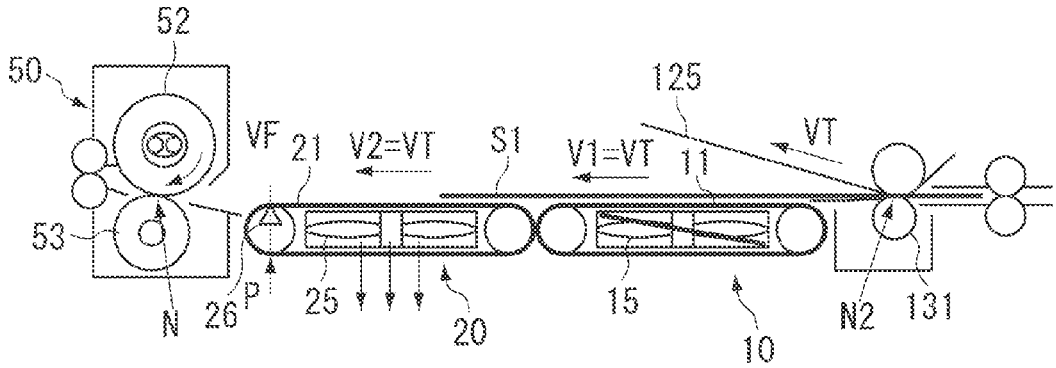
FIGS. 8A to 8D illustrate schematic diagrams illustrating operation in a case where a large-size sheet is conveyed in a mode in which the fixing speed is higher than the transfer speed in the first exemplary embodiment.

In such an operation state, the sheet sent out from the transfer nip N2 is conveyed by the first belt conveyance unit 10. The sheet is sent to the second belt conveyance unit 20 by the first belt conveyance unit 10 and the leading edge side of the sheet is conveyed by the second belt conveyance unit 20. At this point, the circumferential speed of the first conveyance belt 11 (the conveyance speed V1 of the first belt conveyance unit 10) is set to the first speed at which the sheet advancing from the transfer nip N2 is received (in the present exemplary embodiment, the first speed is equal to 300 mm/sec being the transfer speed). The circumferential speed of the second conveyance belt 21 (the conveyance speed V2 of the second belt conveyance unit 20) is set also to the first speed (300 mm/sec) at which the sheet advancing from the transfer nip N2 is received. Therefore, as illustrated in FIG. 8A, although the sheet S1 lies on the first and second conveyance belts 11 and 12 and the trailing edge of the sheet S1 is still nipped by the secondary transfer nip N2, the sheet is smoothly conveyed. The smooth conveyance of the sheet satisfactorily transfers the toner image in the secondary transfer nip N2.

Figure 8B:
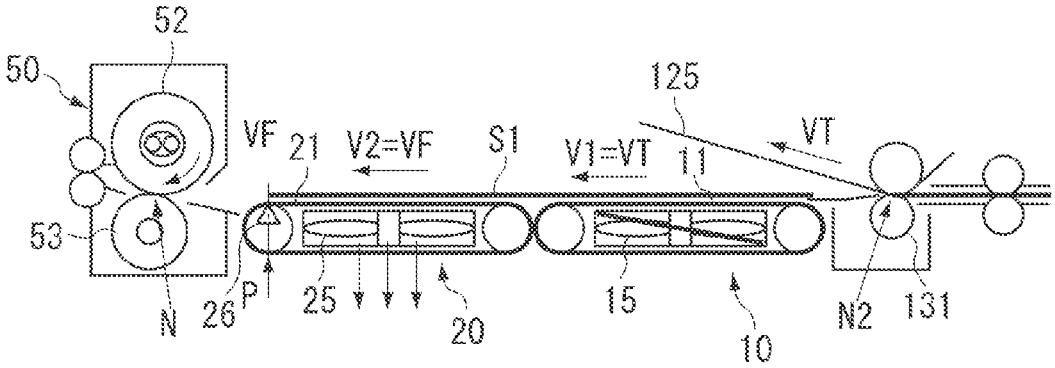

In step S22, the control unit 170 determines whether the leading edge of the sheet conveyed by the first and second conveyance belts 11 and 12 is detected by the sheet leading edge detection sensor 26. FIG. 8B illustrates a state at the time when the leading edge of the sheet conveyed by the first and second conveyance belts 11 and 12 reaches the sheet leading edge detection sensor 26.

If the leading edge of the sheet conveyed by the first and second conveyance belts 11 and 12 reaches a detection position P (YES in step S22), then in step S23, the control unit 170 controls the second conveyance belt drive motor 24 so that the conveyance speed V2 of the second belt conveyance unit 20 is changed from 300 mm/sec as the first speed to the fixing speed VF as a second speed at which the leading edge of the sheet enters the fixing nip N. As described above, the fixing speed VF is set according to the type and grammage of the sheet with reference to the table in FIG. 4.

It is exemplified herein that the second speed of the second belt conveyance unit 20 at which the leading edge of the sheet enters the fixing nip N is equal to the fixing speed. However, the second speed of the second belt conveyance unit 20 has only to be a speed at which the sheet can be conveyed such that the toner image can be satisfactorily fixed when the leading edge of the sheet enters the fixing nip N and does not always need to be equal to the fixing speed. For example, the second speed at which the leading edge of the sheet enters the fixing nip N may be lower by several percent or higher by several percent than the fixing speed. If the second speed of the second conveyance belt 21 is made higher by several percent than the fixing speed, the sheet is bent between the second conveyance belt 21 and the fixing nip N according as the sheet is conveyed after the leading edge of the sheet enters the fixing nip N. If the second speed of the second conveyance belt 21 is made lower by several percent than the fixing speed, the sheet is conveyed while sliding on the second conveyance belt 21 after the leading edge of the sheet enters the fixing nip N.

As described above, the detection position P where the sheet leading edge detection sensor 26 detects the leading edge of the sheet is set to such a position that the trailing edge of the sheet passes the secondary transfer nip N2 when the leading edge of the sheet reaches the detection position P. For this reason, the trailing edge of the sheet already passes the secondary transfer nip N2 when the conveyance speed of the second belt conveyance unit 20 is increased from 300 mm/sec to the second speed (the fixing speed VF in the present exemplary embodiment). Accordingly, the increase of the conveyance speed of the second belt conveyance unit 20 from the first speed to the second speed does not affect the transfer of the toner image to the sheet. The detection position P is set to such a position that the second belt conveyance unit 20 can complete the increase of the conveyance speed of the second belt conveyance unit 20 from the first speed to the second speed until the leading edge of the sheet S1 reaches the fixing nip N of the fixing unit 50.

In the first exemplary embodiment, the following sheet conveyance is performed by stopping the first suction fan 15 and operating the second suction fan 25. More specifically, the stoppage of the first suction fan 15 does not cause the circumferential surface of the first conveyance belt 11 to suck the sheet and the operation of the second suction fan 25 causes the circumferential surface of the second conveyance belt 21 to suck the sheet. As a result, the conveyance force of the second conveyance belt 21 is greater than that of the first conveyance belt 11. Therefore, the sheet is conveyed at the second speed while sliding on the first conveyance belt 11 by the second conveyance belt 21 whose speed is changed to the second speed higher than the circumferential speed of the first conveyance belt 11 and the leading edge of the sheet S1 reaches the fixing nip N.

Figure 8C:
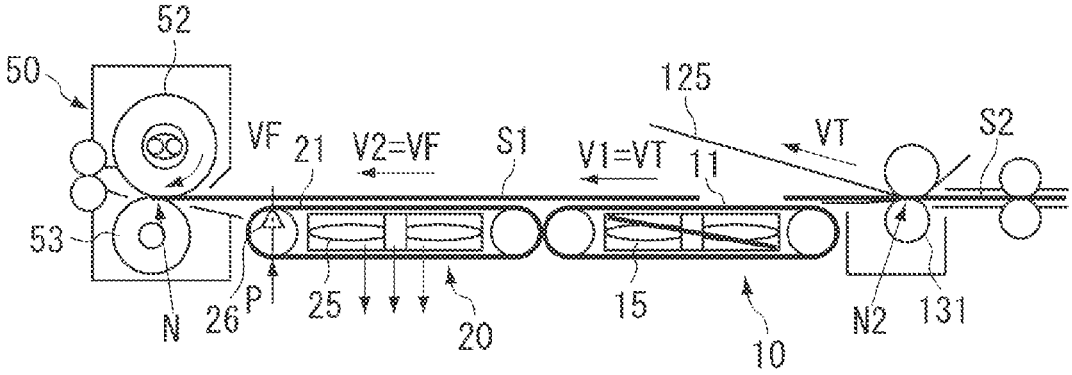
Figure 8D:
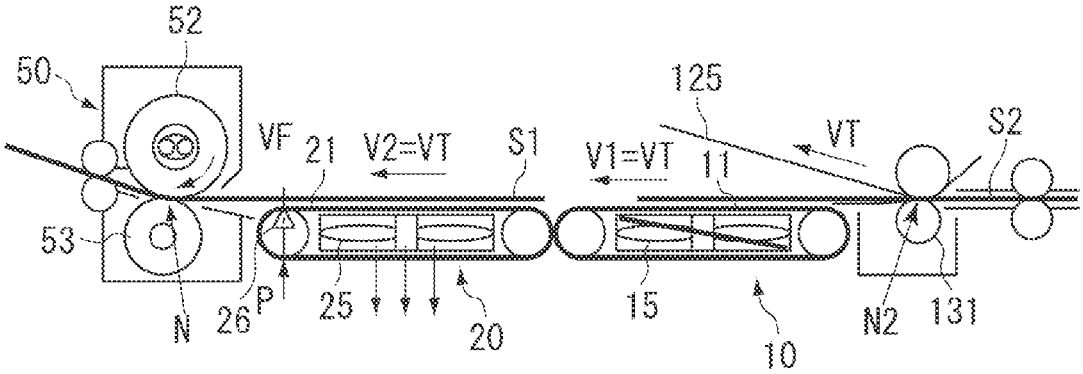

While the sheet is being conveyed while sliding on the first conveyance belt 11 by the second conveyance belt 21, a succeeding sheet S2 conveyed by the secondary transfer nip N2 is conveyed by the first conveyance belt 11 as illustrated in FIG. 8C. Setting the conveyance speed of the first belt conveyance unit 10 to the first speed (transfer speed) stably conveys the succeeding sheet S2. In other words, the circumferential speed of the first conveyance belt 11 is kept at the first speed (transfer speed) to allow the conveyance of continuous sheets with the space interval therebetween shortened, increasing the productivity of image formation. Thus, the leading edge of the succeeding sheet S2 is caused to lie on the first conveyance belt 11 while a stable conveyance is being realized, with the fixing nip N fixing the toner image to the preceding sheet S1, whose trailing edge lies on the first conveyance belt 11. This allows shortening the space interval between the trailing edge of the preceding sheet S1 and the leading edge of the succeeding sheet S2 to increase productivity.

When the leading edge of the sheet S1 conveyed by the second belt conveyance unit 20 reaches the fixing nip N, the sheet S1 conveyed at the second speed (the fixing speed VF, in the present exemplary embodiment) at which the leading edge of the sheet S1 enters the fixing nip N. A great difference between the conveyance speed of the second belt conveyance unit 20 and the fixing speed VF at the fixing nip N at the time when the leading edge of the sheet S1 enters the fixing nip N causes a defective fixing. Conveying the sheet while sliding on the first conveyance belt 11 by the second c belt conveyance unit 20 at the second speed (the fixing speed VF) at which the leading edge of the sheet S1 enters the fixing nip N does not cause defects in fixing the toner image.

After the control unit 170 determines that the leading edge of the sheet S1 reaches the fixing nip N (YES in step S24), then in step S25, the control unit 170 controls the second conveyance belt drive motor 24 so that the conveyance speed of the second belt conveyance unit 20 is changed from the fixing speed VF being the second speed to 300 mm/sec being the first speed. As described below, the control unit 170 determines whether the leading edge of the sheet S1 reaches the fixing nip N. The control unit 170 receives the signal indicating that the leading edge of the sheet S1 is detected from the sheet leading edge detection sensor 26. The timer 666 measures whether a predetermined time interval required by the leading edge of the sheet S1 for reaching the fixing nip N passes after the control unit 170 receives the signal from the sheet leading edge detection sensor 26, and the control unit 170 determines whether the leading edge of the sheet S1 reaches the fixing nip N.

The reason the conveyance speed of the second belt conveyance unit 20 is reduced to the transfer speed being the first speed after the leading edge of the sheet S1 is nipped by the fixing nip N is that an auxiliary transfer is sufficient for the function required by the second belt conveyance unit 20 after the leading edge of the sheet S1 is nipped by the fixing nip N. After the conveyance speed of the second belt conveyance unit 20 is reduced to the transfer speed, the sheet conveyed by the fixing nip N is conveyed while sliding the second conveyance belt 21. This is because a high nipping pressure of the fixing nip N makes the conveyance force of the fixing unit 50 stronger than that of the second conveyance belt 21.

The reason the conveyance speed of the second belt conveyance unit 20 is reduced to the transfer speed being the first speed in a state where the leading edge of the sheet S1 is nipped by the fixing nip N and the trailing edge of the sheet S1 lies on the second conveyance belt 21 is described below. The reason is that the leading edge of the succeeding sheet S2 is allowed to reach the second conveyance belt 21 while the preceding sheet S1 is conveyed by the fixing nip N. This allows providing the image forming apparatus high in productivity because continuous sheets can be conveyed with the space interval therebetween shortened. While the trailing edge of the succeeding sheet S2 lies at the secondary transfer nip N2, both of the circumferential speed of the first and second conveyance belts 11 and 21 are equal to the first speed at which the sheet advancing from the transfer nip N2 is received, so that the succeeding sheet S2 can be stably conveyed to prevent a defective transfer from being produced.

The control unit 170 reduces the conveyance speed of the second belt conveyance unit 20 to 300 mm/sec being the first speed in step S25 and then, in step S26, the control unit 170 determines whether the job is ended. If the job is not ended (NO in step S26), the processing returns to step S22. If the job is ended (YES in step S26), the processing returns to step S3 in FIG. 6 and ends.

Figure 10A:
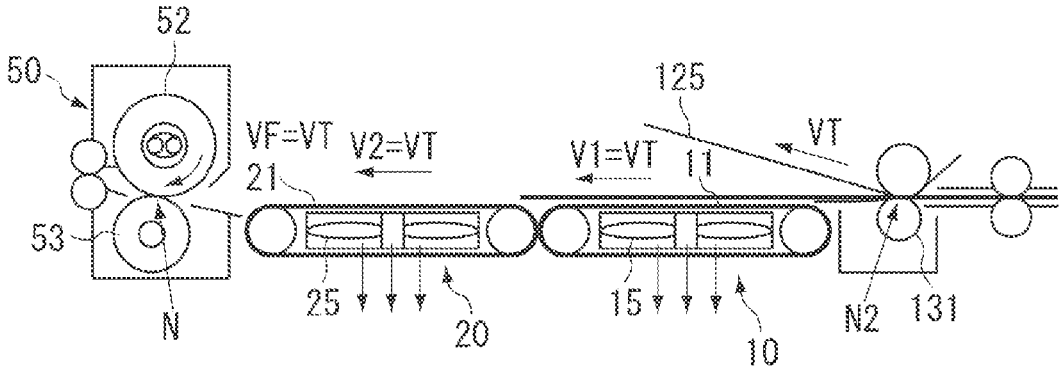
FIGS. 10A and 10B illustrate schematic diagrams illustrating operation in a case where the large-size sheet is conveyed in a mode in which the fixing speed is equal to the transfer speed in the first exemplary embodiment.
Figure 10B:
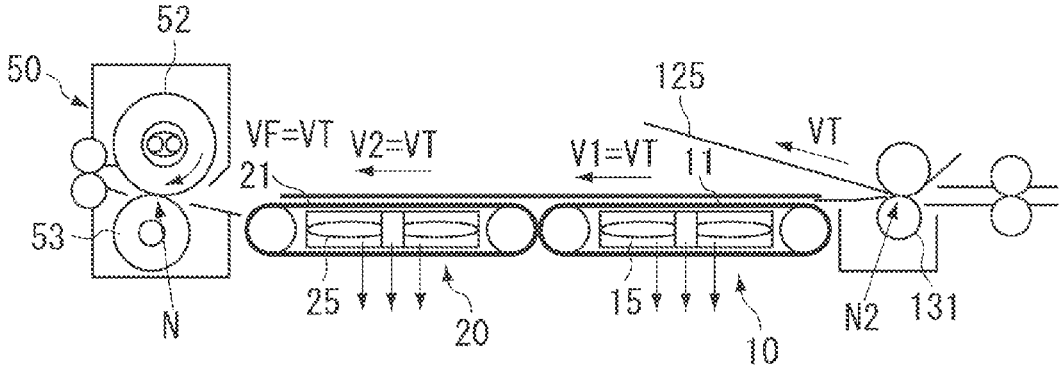

If the mode is the mode 4 in step S1, in other words, if the control unit 170 determines that the fixing speed VF is equal to the transfer speed VT, the processing proceeds to step S4. In step S4, the control unit 170 operates (ON) the first suction and second suction fans 15 and 25. The control unit 170 controls the first conveyance belt drive motor 14 so that the conveyance speed of the first belt conveyance unit 10 is changed to the first speed (300 mm/sec being the transfer speed). The control unit 170 further controls the second conveyance belt drive motor 24 so that the conveyance speed of the second belt conveyance unit 20 is changed to the first speed (300 mm/sec being the transfer speed). Continuous sheets are conveyed as it is. FIGS. 10A and 10B illustrate time-series charts in a case where the fixing speed is equal to the transfer speed and a large-size sheet is conveyed.

If the mode is not the mode 4 in step S1 in FIG. 6 (in a case where the fixing speed is higher than the transfer speed) and the sheet is small (YES in step S2), the processing proceeds to step S5. In step S5, the control unit 170 operates (ON) the first suction and second suction fans 15 and 25. The control unit 170 controls the first conveyance belt drive motor 14 so that the conveyance speed of the first belt conveyance unit 10 is changed to the first speed (300 mm/sec being the transfer speed). The control unit 170 further controls the second conveyance belt drive motor 24 so that the conveyance speed of the second belt conveyance unit 20 is changed to the second speed (equal to the fixing speed VF). Continuous sheets are conveyed as it is.

FIGS. 9A to 9D illustrate time-series charts in a case where a small-size sheet is continuously conveyed at the fixing speed higher than the transfer speed. The small-size refers to a size in which the trailing edge of a sheet passes the secondary transfer nip N2 when the leading edge thereof reaches the second conveyance belt 21, and the trailing edge of the sheet passes the first conveyance belt 11 when the leading edge thereof reaches the fixing nip N. FIGS. 9A to 9D illustrate a conveyance state in a case where the transfer speed is faster than the fixing speed and the sheet to be conveyed is of small-sized.

Figure 9A:
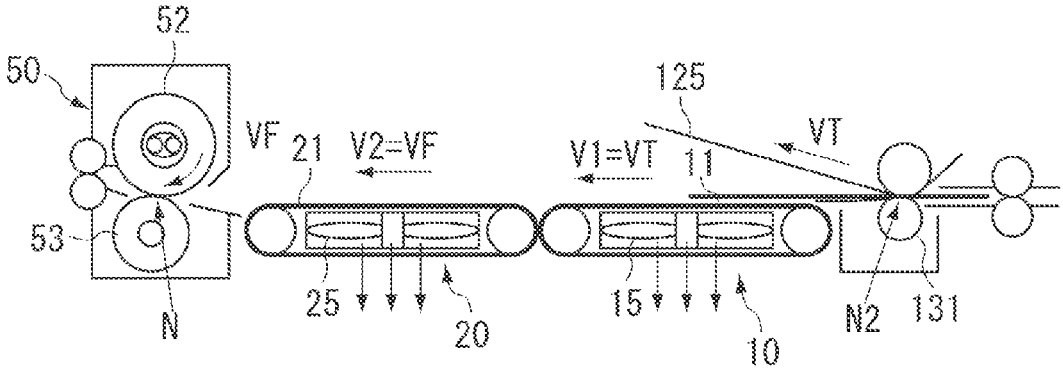
FIGS. 9A to 9D illustrate schematic diagrams illustrating operation in a case where a small-size sheet is conveyed in a mode in which the fixing speed is higher than the transfer speed in the first exemplary embodiment.

FIG. 9A illustrates that the sheet to which the toner image is transferred at the transfer nip N2 is conveyed by the first conveyance belt 11 whose circumferential speed is set to the transfer speed VT and which is performing a suction operation.

Figure 9B:
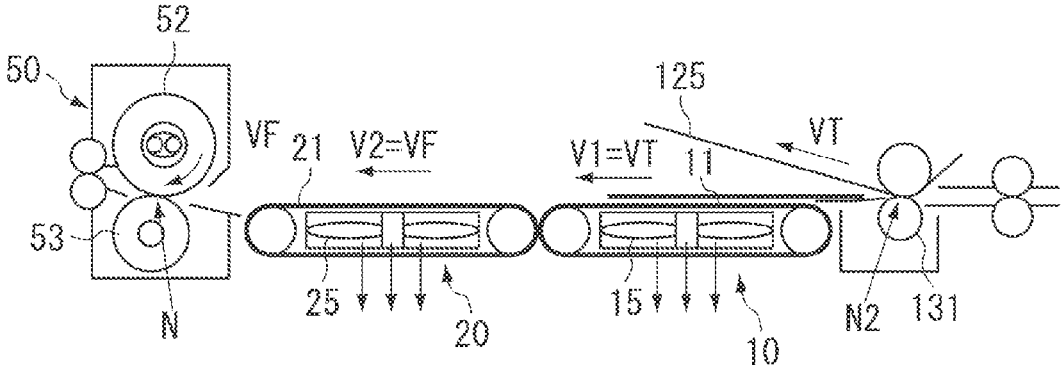

As illustrated in FIG. 9B, before the leading edge of the sheet carried by the first conveyance belt 11 reaches the second conveyance belt 21, the trailing edge of the sheet leaves the transfer nip N2. When the leading edge of the sheet contacts the second conveyance belt 21 which is rotated at the second speed higher than the transfer speed and performs a suction operation, the transfer of the toner image to the sheet at the secondary transfer nip N2 is already completed. Therefore, the rotation of the second conveyance belt 21 at the second speed higher than the transfer speed as it is does not affect the transfer of the toner image by the second conveyance belt 21.

Figure 9C:
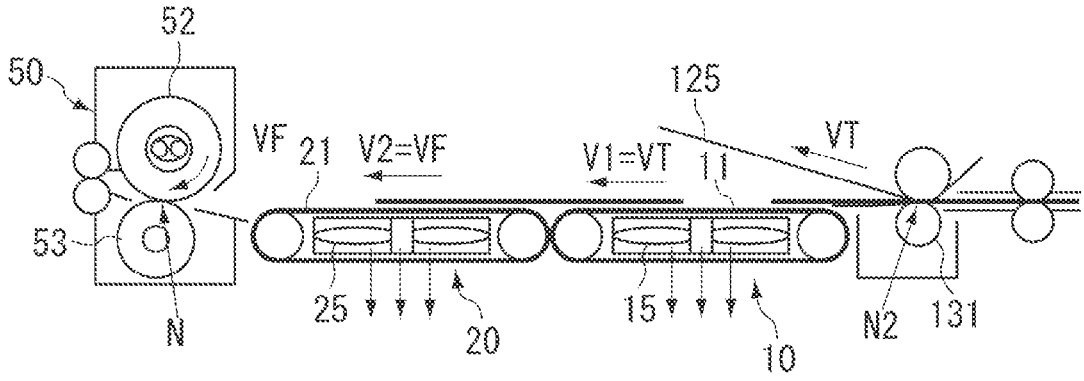

FIG. 9C illustrates a transient state in which the leading edge of the sheet reaches the second conveyance belt 21 and the sheet bridges the first and second conveyance belts 11 and 21. In an initial state where the major portion of the sheet lies on the first conveyance belt 11 and a part of the leading edge of the sheet contacts the second conveyance belt 21, the sheet is conveyed as described below. The sheet is conveyed at the first speed by the first conveyance belt 11 while being sucked by the first conveyance belt 11 and the part of the leading edge of the sheet slides on the second conveyance belt 21 rotated at the high second speed. Thereafter, the sheet advances and is sucked by the second conveyance belt 21 according as the area is increased where the sheet contacts the second conveyance belt 21. The sheet is pulled and conveyed by the second conveyance belt 21 while sliding on the first conveyance belt 11. The sheet is conveyed at the high speed by the second conveyance belt 21 before the trailing edge of the sheet passes the downstream end of the first conveyance belt 11, so that the time period for which the sheet advancing from the transfer nip N2 reaches the fixing nip N is short, which increases productivity.

Figure 9D:
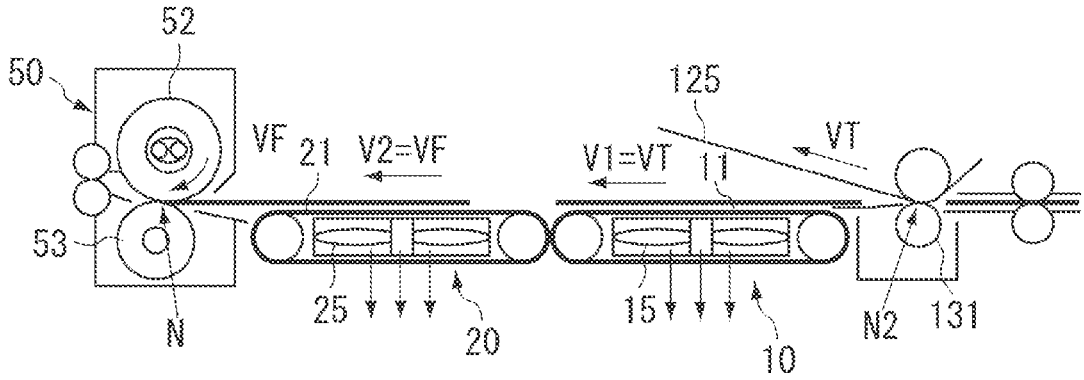

Thereafter, as illustrated in FIG. 9D, the leading edge of the sheet reaches the fixing nip N after the trailing edge of the sheet passes the first conveyance belt 11. The trailing edge of the sheet passes the downstream end of the first conveyance belt 11 when the leading edge of the sheet reaches the fixing nip N, so that the sheet is conveyed at the second speed by the second conveyance belt 21 without being affected by the first conveyance belt 11.

In the present exemplary embodiment, in the large-size conveyance control, the control unit 170 stops (OFF) the rotation of the first suction fan 15 of the first belt conveyance unit 10 and operates (ON) the second suction fan 25 of the second belt conveyance unit 20. Thereby, the second conveyance belt 21 becomes greater in the force of conveying the sheet S than the first conveyance belt 11 to allow the sheet to be conveyed while being pulled by the second conveyance belt 21 and sliding on the first conveyance belt 11. Alternatively, for example, a difference in a suction force may be provided between the first and second suction fans 15 and 25 by half rotating the first suction fan 15 and fully rotating the second suction fan 25 to make the second conveyance belt 21 greater in the conveyance force than the first conveyance belt 11, thereby sliding the sheet on the first conveyance belt 11. Still alternatively, a shutter may be provided between the first suction fan 15 and the first conveyance belt 11 instead of a configuration in which the rotation of the first suction fan 15 is stopped. More specifically, air current of the first suction fan 15 is shut off by the shutter to reduce the suction force of the first conveyance belt 11, decreasing the conveyance force of the first conveyance belt 11.

Alternatively, in the large-size conveyance control, with the second suction fan 25 kept operated, the second conveyance belt 21 can be made greater in the force of conveying the sheet than the first conveyance belt 11 to cause the sheet to slide on the first conveyance belt 11. For example, their respective conveyance forces may be adjusted in designing by adjusting the number of holes and the size of the hole formed in the first and second conveyance belts 11 and 21, i.e., aperture ratio. More specifically, the aperture ratio of the second conveyance belt 21 is made greater than that of the first conveyance belt 11 to provide a difference between a force of the first suction fan 15 sucking the sheet against the first conveyance belt 11 and a force of the second suction fan 25 sucking the sheet against the second conveyance belt 21. Thereby, the second conveyance belt 21 is made greater in the force of conveying the sheet than the first conveyance belt 11 to cause the sheet to slide on the first conveyance belt 11. The frictional coefficient of the conveyance surface of the first conveyance belt 11 is made smaller than that of the second conveyance belt 21 to make a sheet conveying force of the second conveyance belt 21 sucking the sheet greater than that of the first conveyance belt 11 sucking the sheet, thereby, the sheet may be conveyed while being pulled by the second conveyance belt 21 and sliding on the first conveyance belt 11. For example, the surface of the conveyance belt on which the sheet is conveyed is coated with Teflon (registered trademark) to allow decreasing the frictional coefficient of the sheet conveyance surface to 0.3 to 0.4 from 1.0 to 1.2. The surface of the first conveyance belt 11 on which the sheet is conveyed is coated with Teflon (registered trademark) and the second conveyance belt is made of rubber high in frictional coefficient, for example. Thus, the frictional coefficient of the surface of the first conveyance belt 11 on which the sheet is conveyed is made smaller than that of the surface of the second conveyance belt 21 on which the sheet is conveyed. Such a configuration makes a sheet conveying force of the second conveyance belt 21 sucking the sheet greater than that of the first conveyance belt 11 sucking the sheet, which enables the second conveyance belt 21 to surely pull the sheet and causes the sheet to slide on the first conveyance belt 11.

As described above, the aperture ratio of the first and second conveyance belts 11 and 21 is adjusted. The frictional coefficient of the first conveyance belt 11 is made smaller than that of the second conveyance belt 21. Such a configuration is advantageous in conveying the small-sized sheet in a mode in which the fixing speed is higher than the transfer speed. The speed of the sheet depends on the second conveyance belt 21 high in speed at the early time of the transient state in which the sheet is conveyed with the sheet bridging the first and second conveyance belts 11 and 21 (refer to FIG. 9C). This is because the sheet from the transfer nip N2 reaches the fixing nip N earlier. In a case where the small-sized sheet is conveyed in a mode in which the fixing speed is higher than the transfer speed, the sheet conveyance force of the first conveyance belt 11 may be reduced by lowering the suction of the first suction fan 15 in the first belt conveyance unit 10. Also in this control, the speed of the sheet depends on the second conveyance belt 21 high in speed at the early time of the transient state (refer to FIG. 9C).

In the present exemplary embodiment, in the large-size conveyance control, the control unit 170 determines the timing at which the conveyance speed of the second belt conveyance unit 20 is changed from the first speed (the transfer speed) to the second speed (the fixing speed VF) depending on whether the leading edge of the sheet is detected by the sheet leading edge detection sensor 26. However, the timing at which the conveyance speed of the second belt conveyance unit 20 is made faster from the first speed to the second speed has only to be performed after the trailing edge of the sheet to be conveyed passes the secondary transfer nip N2, so that the present invention is not always limited to the above configuration. For example, a sensor for detecting the sheet is provided in the vicinity of the registration roller 115. A signal is received from the sensor and then the timer 666 measures whether the time required for the trailing edge of the sheet passing the secondary transfer nip N2 elapses. Thus, the control unit 170 determines that the trailing edge of the sheet passes the secondary transfer nip N2. Alternatively, a sensor for detecting that the trailing edge of the sheet passes the transfer nip N2 may be provided between the transfer nip N2 and the first conveyance belt 11 and the conveyance speed of the second belt conveyance unit 20 may be changed based on the signal of the sensor.

The first exemplary embodiment described above achieves the following effects.

(1) The fixing speed VF is changed according to the type and grammage of the sheet S. For this reason, the fixing unit can provide the sheet with an appropriate quantity of heat according to the type and grammage of the sheet S with the temperature of the fixing unit kept at a constant regulated temperature.

(2) The first and second belt conveyance units 10 and 20 arranged in the conveyance direction are provided between the secondary transfer nip N2 and the fixing nip N. The conveyance speed V1 of the first belt conveyance unit 10 is taken as the first speed at which the sheet advancing from the transfer nip N2 is received. The conveyance speed V2 of the second belt conveyance unit 20 can be changed between the first speed and the second speed which is higher than the first speed and at which the leading edge of the sheet enters the fixing nip N. Therefore, the sheet S can be smoothly conveyed from the secondary transfer nip N2 to the fixing nip N. Switching the conveyance speed of the sheet S between the secondary transfer nip N2 and the fixing nip N allows the transfer speed VT to be kept constant irrespective of the setting value of the fixing speed VF.

(3) Even if the large-sized sheet is conveyed in a mode in which the fixing speed VF is higher than the transfer speed, the sheet can be stably conveyed with a high productivity using the conveyance belt short in length in the conveyance direction.

The sheet is conveyed at the high second speed while sliding on the first conveyance belt 11 whose circumferential speed is the first speed by the second conveyance belt 21 whose speed is set to the second speed at which the leading edge of the sheet enters the fixing nip and, in this state, the leading edge of the sheet is caused to reach the fixing nip N. The second conveyance belt 21 is minimized so that the length of the conveyance path from the downstream end of the first conveyance belt 11 to the fixing nip N can be made smaller than that of the sheet to be conveyed and the speed of the sheet can be increased. The second conveyance belt 21 is minimized and the speed of the sheet is changed to the high second speed at the time early before the trailing edge of the sheet leaves the first conveyance belt 11, so that the sheet advancing from the secondary transfer nip N2 reaches early the fixing nip N. Thus, the length between the secondary transfer nip N2 and the fixing nip N can be shortened, the image forming apparatus can be minimized, and productivity is high.

The succeeding sheet sent from the secondary transfer nip N2 can be received by the first conveyance belt 11 rotated at the first speed while the preceding sheet bridging the first and second conveyance belts 11 and 21 is being conveyed at the second speed (the fixing speed) by the second conveyance belt 21. A short interval between the continuously conveyed sheets with the toner image being satisfactorily transferred increases productivity.

In order that the image forming apparatus is downsized by reducing the length of the conveyance path between the transfer nip N2 and the upstream end of the second conveyance belt 21, in the case of the large-size sheet, the circumferential speed of the second conveyance belt 21 is set to the first speed until the trailing edge of the sheet passes the transfer nip N2 and then the circumferential speed of the second conveyance belt 21 is increased. Thus, the length of the conveyance path between the transfer nip N2 and the upstream end of the second conveyance belt 21 is reduced and the speed of the sheet is increased before the trailing edge of the sheet leaves the downstream end of the first conveyance belt 11 so that the time required for sheet reaching the fixing nip N from the transfer nip N2 is short.

Thus, the length between the secondary transfer nip N2 and the fixing nip N is reduced and the fixing speed VF is made higher than the transfer speed VT to allow productivity to be increased and the sheet to be smoothly conveyed.

(4) In the case of the small-size sheet which is shorter than the length between the transfer nip N2 and the upstream end of the second conveyance belt 21 and shorter than the length between the downstream end of the first conveyance belt 11 and the fixing nip N, the following control is performed even in a mode in which the fixing speed is higher than the transfer speed. The sheet is conveyed without the circumferential speed of the first and second conveyance belts and the state of suction thereof being changed during the conveyance of the sheet. Therefore, in this case, a complicated control is not required in the conveyance process, the speed of the sheet is changed to a high speed at an early timing and productivity is high.

The distance between the secondary transfer nip N2 and the transfer nip N is longer than the length of the maximum-sized conveyable sheet. As illustrated in FIG. 9B, for example, the leading edge of the sheet carrying the toner image yet to be fixed reaches the fixing nip N after the trailing edge of the sheet S1 passes the secondary transfer nip N2. For this reason, even if shock is caused when thick paper plunges into the fixing nip N, image defectiveness can be minimized because the tailing edge of the sheet S1 passes the secondary transfer nip N2.

In the first exemplary embodiment, in the large-size conveyance control, the conveyance speed of the second belt conveyance unit 20 is changed while the sheet is being conveyed, and in the large-size conveyance control, the suction operation of the first and second suction fans 15 and 25 is not changed while the sheet is being conveyed. The second exemplary embodiment is different from the first exemplary embodiment in that, in the large-size conveyance control, the suction operation of the first and second belt conveyance unit 10 and 20 is changed without the conveyance speed of the second belt conveyance unit 20 being changed while the sheet is being conveyed. The detailed description of the configuration of the second exemplary embodiment similar to the description of the first exemplary embodiment is omitted and only the points different from the first exemplary embodiment are described in detail below.

Figure 11:
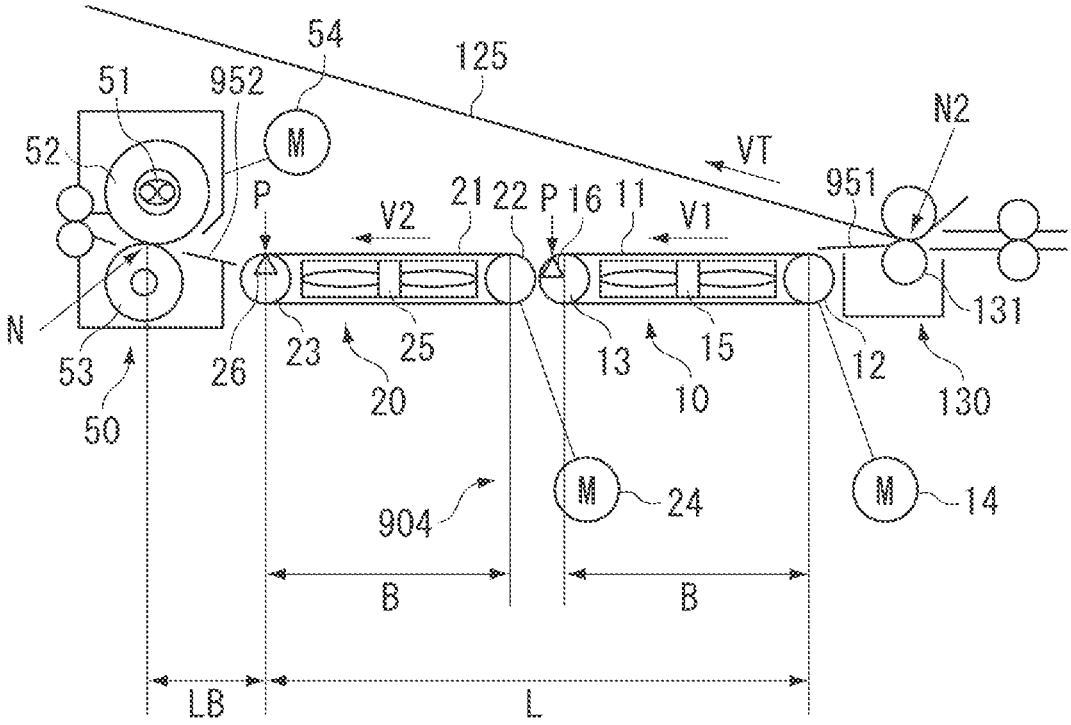
FIG. 11 is an enlarged view between a secondary transfer unit and the fixing unit in a second exemplary embodiment.

FIG. 11 is an enlarged view between a secondary transfer unit 131 and the fixing unit 50 in the image forming apparatus of the second exemplary embodiment. As illustrated in FIG. 11, an upstream sheet leading edge detection sensor 16 for detecting the leading edge of the sheet at an upstream detection position P1 is provided on the side of the fixing unit 50 in the first conveyance belt 11.

A configuration for sucking the sheet against the conveyance belt in the first and second belt conveyance units 10 and 20 is described in detail below with reference to FIGS. 12A and 12B and FIGS. 13A and 13B. The first and second belt conveyance units 10 and 20 are similar to each other in configuration, so that the second belt conveyance unit 20 is described herein and the detailed description of the first belt conveyance unit 10 is omitted.

Figure 12A:
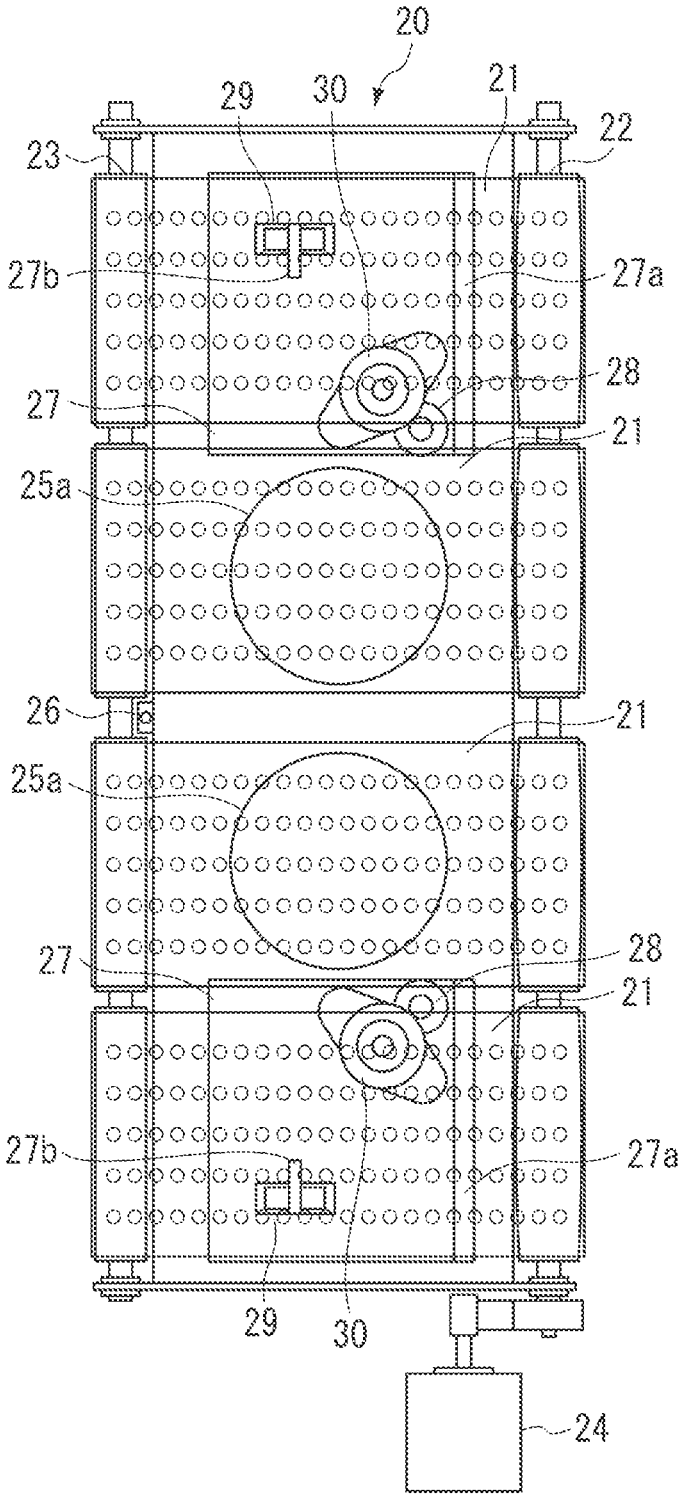
FIGS. 12A and 12B illustrate top views of a second conveyance belt unit in the second exemplary embodiment.
Figure 12B:
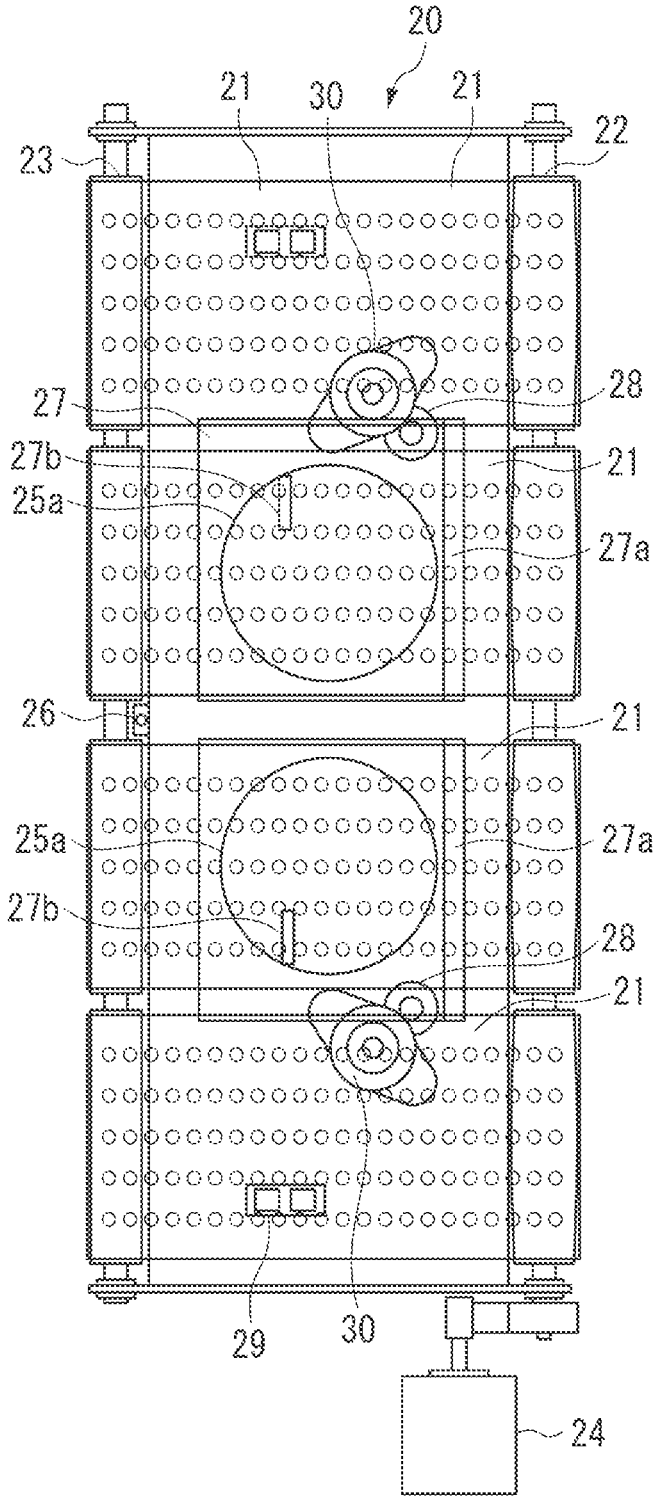
Figure 13A:
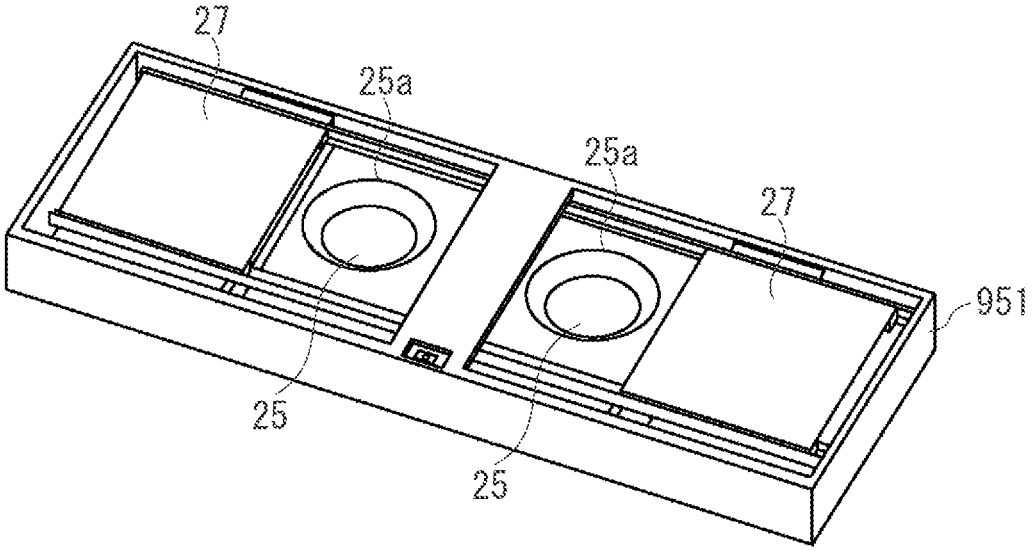
FIGS. 13A and 13B illustrate perspective views of the second conveyance belt unit in the second exemplary embodiment.
Figure 13B:
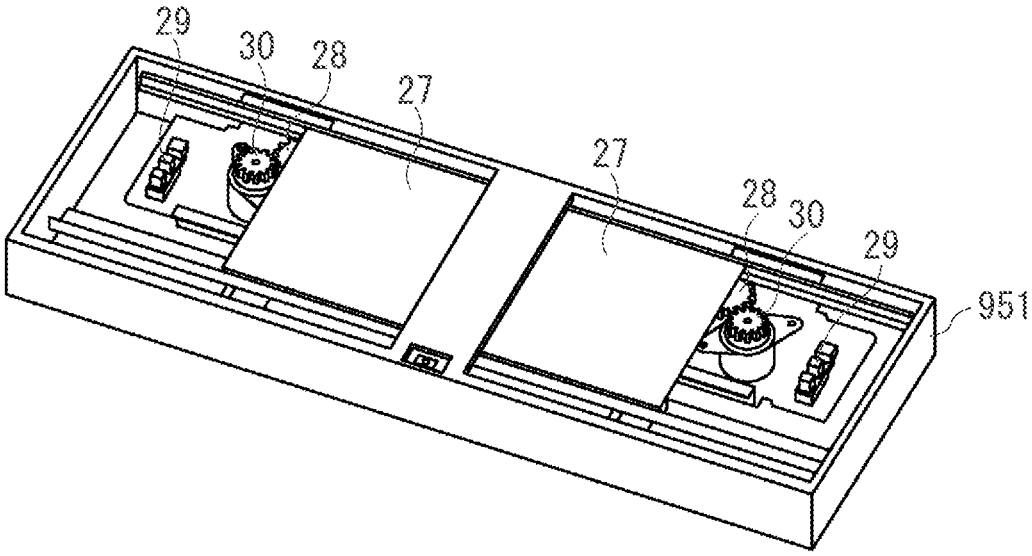

FIGS. 13A and 13B are perspective views of the second belt conveyance unit 20 with the drawing of the second conveyance belt 21 omitted for the sake of better comprehension of the configuration. Inside the second conveyance belt 21 is provided a frame 951 incorporating the second suction fan 25. On the upper surface of the frame 951 is formed a pair of suction ports 25*a*. A pair of second shutters 27 is slidably held by the frame 951 between the second conveyance belt 21 and the second suction fan 25. The second shutter 27 is held by the frame 951 so that the second shutter 27 can slide between a position where the suction port 25*a* is opened (refer to FIG. 12A and FIG. 13A) and a position where the suction port 25*a* is closed (refer to FIG. 12B and FIG. 13B).

Slidably moving the second shutter 27 comprising the second suction device along with the second suction fan 25 and the frame 951 allows changing the state of sucking the sheet against the second conveyance belt 21 in the second belt conveyance unit 20. Hereinafter, the position of the second shutter 27 where the suction port 25*a* is opened (refer to FIG. 12A and FIG. 13A) is referred to as an open position and the position of the second shutter 27 where the suction port 25*a* is closed (refer to FIG. 12B and FIG. 13B) is referred to as a closed position. In a case where the second shutter 27 is in the open position illustrated in FIGS. 12A and 13A, the sheet is sucked against the second conveyance belt 21. In a case where the second shutter 27 is in the closed position illustrated in FIGS. 12B and 13B, the sheet is not sucked against the second conveyance belt 21.

The second shutters 27 are provided with rack gears. The transmission of the driving force of a second shutter drive motor 30 to the second shutter 27 via a pinion gear engaging with the rack gear slides the second shutter 27 in the width direction to cause the suction port 25*a* of the second suction fan 25 to open or close.

The second shutters 27 are provided with flags 27*b*. The second shutter 27 is moved to the open position illustrated in FIGS. 12A and 13A as described below. The second shutter drive motor 30 is driven. When the flag 27*b* interrupts the optical axis of a second shutter detection sensor 29 to turn the signal from the second shutter detection sensor 29 ON from OFF, the second shutter drive motor 30 is stopped. On the other hand, in a case where the second shutter 27 is moved to the closed position as illustrated in FIGS. 12B and 13B, the second shutter drive motor 30 is reversely rotated by the predetermined number of pulses.

The first belt conveyance unit 10 is also similar to the second belt conveyance unit 20 in the shutter and the mechanism for moving the shutter. More specifically, a first shutter composing a first suction device along with a first suction fan 15 is provided between the first suction fan 15 and the first conveyance belt 11 inside the first conveyance belt 11. The first shutter is slidably moved by a first shutter drive motor.

Figure 14:
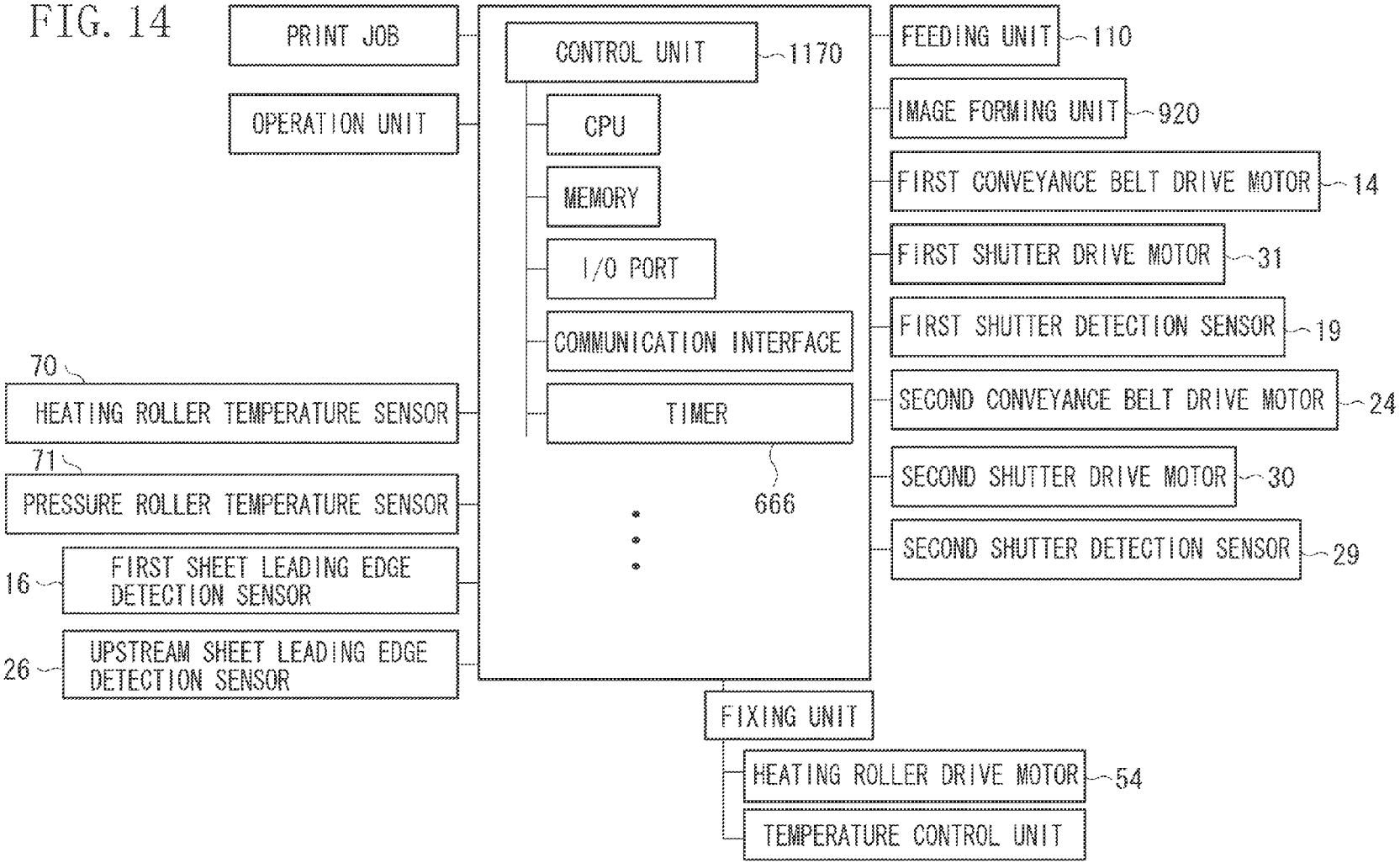
FIG. 14 is a block diagram illustrating the control unit of the image forming apparatus according to the second exemplary embodiment.

In the second exemplary embodiment illustrated in FIG. 14, signals are input to a control unit 1170 from an upstream leading edge detection sensor 16 and a sheet leading edge detection sensor 26. The control unit 1170 controls the operation of the first and second conveyance belt drive motors 14 and 24 and the heating roller drive motor 54. Signals are input to the control unit 1170 from a first shutter detection sensor 19 and a second shutter detection sensor 29. The control unit 1170 operates the first and second shutter drive motors 31 and 30 based on the signals from the first and second shutter detection sensors 19 and 29 to move the shutters between the open and the closed positions. The control unit 1170 controls the suction operation of a suction unit comprised of the first suction device including the first suction fan 15, the first shutter drive motor 31, and a first shutter 17 and the second suction device including the second suction fan 25, the second shutter drive motor 30, and the second shutter 27.

The control unit 1170 changes also the second speed being the conveyance speed of the second belt conveyance unit 20 within the range of 300 mm/sec to 480 mm/sec according to the speed adjustment of the fixing speed VF. The conveyance speed of the second belt conveyance unit 20 is changed by the control unit 1170 controlling a second conveyance belt drive motor 24.

The operation and control of conveyance of the sheet from the secondary transfer nip N2 to the fixing unit 50 are described in detail below with reference to flow charts in FIGS. 15 and 16 and operation charts in FIGS. 17A to 17C and FIGS. 18A and 18B illustrating the conveyance state of the sheet.

The control unit 1170 determines which mode is set based on the type and grammage in FIG. 4 among information about the sheet input from the operation unit. In other words, in step S101, the control unit 1170 determines whether the transfer speed is similar to the fixing speed in mode (mode 4) with reference to the table in FIG. 4.

If the mode is not the mode 4 (or the fixing speed is higher than the transfer speed) (NO in step S101), then in step S102, the control unit 1170 determines whether the sheet is of a small-sized based on information about size among information about the type of the sheet. In the present exemplary embodiment, the control unit 1170 determines that the sheet is of a small-sized in a case where the length of the sheet to be conveyed in the conveyance direction is shorter than the length between the secondary transfer nip N2 and the upstream end of the second conveyance belt 21 and shorter than the length between the downstream end of the first conveyance belt 11 and the fixing nip N. If the sheet is not of a small-sized (NO in step S102), the control unit 1170 executes the large-size conveyance control illustrated in FIG. 16. FIGS. 17A to 17C and FIGS. 18A and 18B are time-series charts illustrating the operation of conveyance of the sheet in a case where the transfer speed is higher than the fixing speed and the sheet is of a large-sized (hereinafter referred to as large-size conveyance control).

Figure 16:
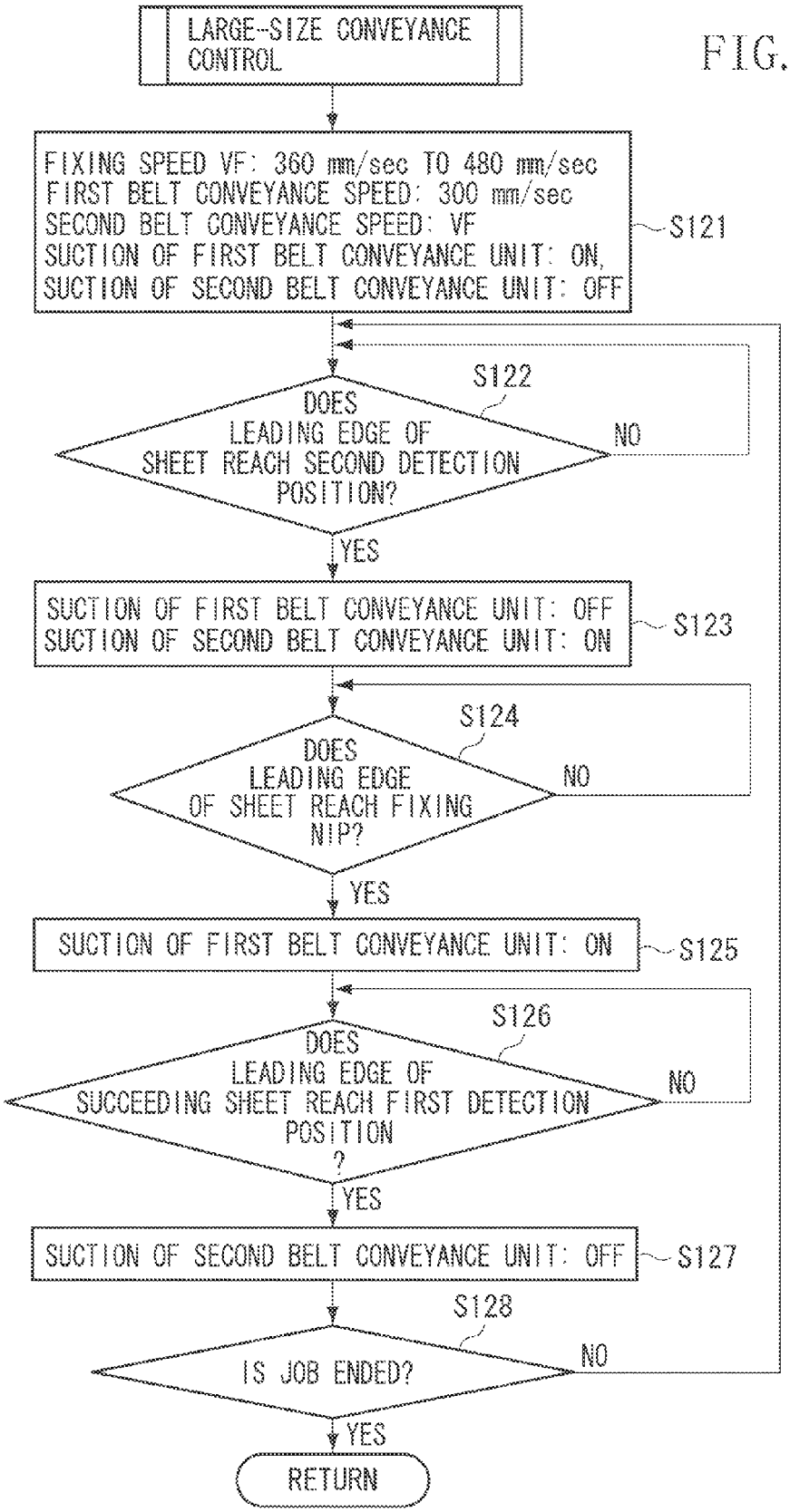
FIG. 16 is a flow chart illustrating a large-size conveyance control in the image forming apparatus according to the second exemplary embodiment.

In step S121, in the large-size conveyance control illustrated in FIG. 16, the control unit 1170 controls the heating roller drive motor 54 so that a fixing speed is kept at the fixing speed VF illustrated in FIG. 4 according to the type and grammage of the sheet. In step S121, the control unit 1170 controls the first conveyance belt drive motor 14 so that the conveyance speed of the first belt conveyance unit 10 becomes equal to 300 mm/sec, which is equal to the transfer speed, as the first speed at which the sheet advancing from the transfer nip N2 is received. In step S121, the control unit 1170 controls the second conveyance belt drive motor 24 so that the conveyance speed of the second belt conveyance unit 20 becomes equal to the fixing speed VF as the second speed at which the leading edge of the sheet enters the fixing nip N. The control unit 1170 performs control so that the sheet is sucked against the first conveyance belt 11 (ON) in the first belt conveyance unit 10. More specifically, the control unit 1170 controls the operation of the first shutter drive motor 31 to move the first shutter 17 to the open position so that the first suction fan 15 sucks the sheet against the first conveyance belt 11. On the other hand, the control unit 1170 performs control so that the sheet is not sucked against the second conveyance belt 21 (OFF). In step S121, the control unit 1170 controls the operation of the second shutter drive motor 30 to move the second shutter 27 to the closed position so that the second suction fan 25 does not suck the sheet against the second conveyance belt 21.

It is exemplified herein that the first speed of the first belt conveyance unit 10 at which the sheet advancing from the transfer nip N2 is received and conveyed is equal to the transfer speed. However, as is the case with the first exemplary embodiment, the first speed of the first belt conveyance unit 10 has only to be speed at which the sheet advancing from the transfer nip N2 can be smoothly conveyed without significantly affecting the transfer of the toner image and does not always need to be equal to the transfer speed.

It is exemplified herein that the second speed of the second belt conveyance unit 20 at which the leading edge of the sheet enters the fixing nip N is equal to the fixing speed. However, as is the case with the first exemplary embodiment, the second speed of the second belt conveyance unit 20 has only to be speed at which the sheet can be conveyed such that the toner image can be satisfactorily fixed when the leading edge of the sheet enters the fixing nip N and does not always need to be equal to the fixing speed VF.

In the operation condition set in step S121, the sheet sent out from the secondary transfer nip N2 is conveyed by the first belt conveyance unit 10. At this point, since the circumferential speed of the first conveyance belt 11 (the conveyance speed of the first belt conveyance unit 10) is set to the first speed (equal to 300 mm/sec being the transfer speed in the present exemplary embodiment) at which the sheet advancing from the transfer nip N2 is received and conveyed and the sheet is sucked against the first conveyance belt 11, the sheet is smoothly conveyed (refer to FIG. 17A).

Figure 17A:
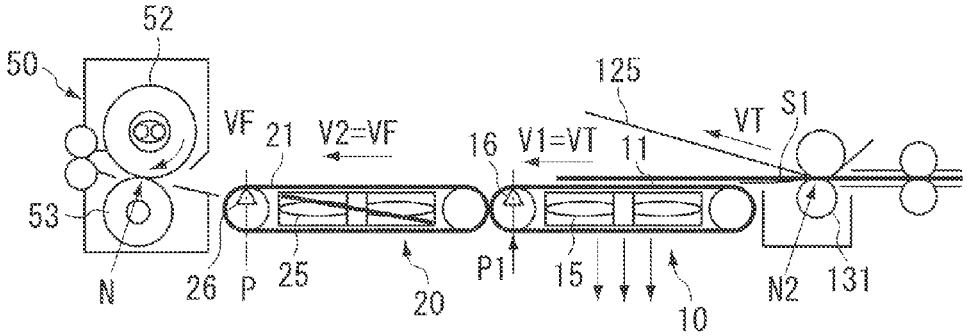
FIGS. 17A to 17C illustrate schematic diagrams illustrating operation in a case where the large-size sheet is conveyed in the mode in which the fixing speed is higher than the transfer speed in the second exemplary embodiment.
Figure 17B:
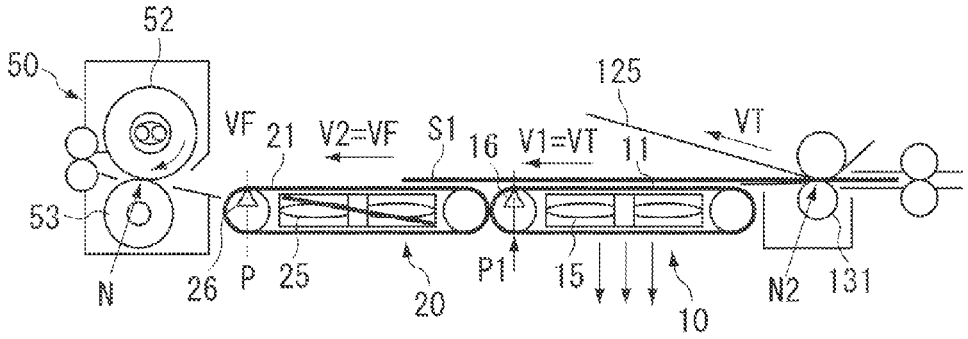

Then, the sheet is sent to the second belt conveyance unit 20 by the first belt conveyance unit 10 and the leading edge of the sheet reaches onto the second belt conveyance unit 20(refer to FIG. 17B). The sheet is not sucked against the second conveyance belt 21 at this point. The conveyance force of the first conveyance belt 11 in the first belt conveyance unit 10, which performs the suction operation, is greater than that of the second conveyance belt 21 in the second belt conveyance unit 20. For this reason, the leading edge of the sheet bridging the first and second conveyance belts 11 and 21 slides on the circumferential surface of the second conveyance belt 21, whose circumferential speed is set to the second speed higher than the transfer speed, and the sheet itself is conveyed at the first speed being the circumferential speed of the first conveyance belt 11. Although the leading edge of the sheet to which the toner image is being transferred at the secondary transfer nip N2 contacts the second conveyance belt 21 rotated at the second speed higher than the first speed, the sheet is conveyed at the first speed by the first conveyance belt 11. Consequently, the toner image is satisfactorily transferred at the secondary transfer nip N2. Hereinafter, such a state is referred to as first suction state, where the operation of the suction unit is controlled to make the conveyance force of the second belt conveyance unit 20 smaller than that of the first belt conveyance unit 10 and the sheet is conveyed at the circumferential speed of the first conveyance belt 11 while sliding on the second conveyance belt 21.

In step S122, the control unit 1170 determines whether the leading edge of the sheet conveyed by the first and second belt conveyance units 10 and 20 is detected by the sheet leading edge detection sensor 26 at the detection position P. If the leading edge of the sheet conveyed by the first and second belt conveyance units 10 and 20 is detected by the sheet leading edge detection sensor 26 (YES in step S122), the processing proceeds to step S123. In step S123, the control unit 1170 controls the operation of the first shutter drive motor 31 to move the first shutter 17 to the closed position so that the sheet is not sucked against the first conveyance belt 11. Furthermore, the control unit 1170 controls the operation of the second shutter drive motor 30 to move the second shutter 27 to the open position so that the sheet is sucked against the second conveyance belt 21.

Figure 17C:
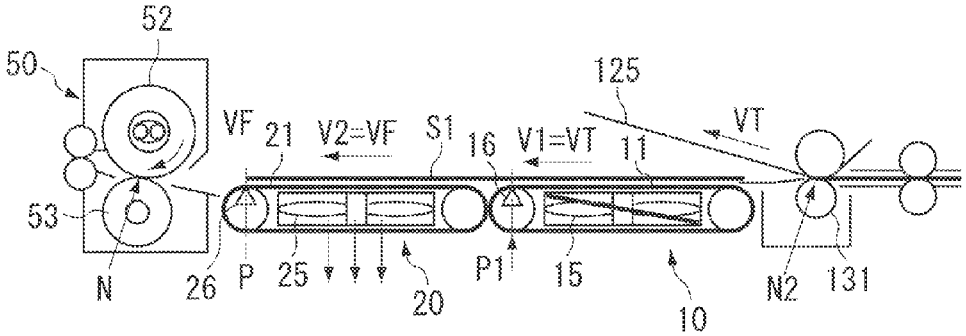

In this state, the sheet is not sucked against the first conveyance belt 11, but the sheet is sucked against the second conveyance belt 21 (a second suction state). Therefore, the conveyance force of the second conveyance belt 21 in the second belt conveyance unit 20, which performs the suction operation, is greater than that of the first conveyance belt 11 in the first belt conveyance unit 10. FIG. 17C illustrates that the leading edge of the sheet conveyed by the first and the second belt conveyance units 10 and 20 reaches the sheet leading edge detection sensor 26 and the operation state of suction of the sheet is completed.

The detection position P is set to such a position that the trailing edge of the sheet already passes the secondary transfer nip N2 when the leading edge of the sheet reaches the detection position P. For this reason, the trailing edge of the sheet already passes the secondary transfer nip N2 when the operation state of suction of the sheet is changed from the first suction state to the second suction state. The change of the suction state to the second suction state does not affect the transfer of the toner image to the sheet. The detection position P is set to such a position that the first and second shutters 17 and 27 can be moved to the close and open positions respectively.

The sheet is conveyed as described below in a state where the sheet is not sucked against the first conveyance belt 11, but the sheet is sucked against the second conveyance belt 21. In other words, the conveyance force of the second conveyance belt 21 which performs the suction operation is greater than that of the first conveyance belt 11 which does not perform the suction operation. The sheet lying on the first and second conveyance belts 11 and 21 is pulled and conveyed by the second conveyance belt 21 whose circumferential speed is set to the second speed higher than that of the first conveyance belt 11 while sliding on the outer circumference of the first conveyance belt 11 at the second speed (the fixing speed in the present exemplary embodiment) at which the leading edge of the sheet enters the fixing nip N. The sheet is pulled by the second conveyance belt 21 at the second speed while sliding on the outer circumference of the first conveyance belt 11 and the leading edge reaches the fixing nip N.

When the leading edge of the sheet S1 conveyed by the second conveyance belt 21 enters the fixing nip N, the sheet is conveyed at the second speed at which the leading edge of the sheet S1 is caused to enter the fixing nip N by the second conveyance belt 21. A great difference between the speed of the sheet at the time when the leading edge of the sheet S1 enters the fixing nip N and the fixing speed at the fixing nip N causes a defective fixing. The sheet pulled and conveyed by the second conveyance belt 21 while sliding on the first conveyance belt 11 is conveyed at the second speed (the fixing speed VF) at which the leading edge of the sheet is caused to enter the fixing nip N, which does not cause defective in fixing the toner image.

In step S124, the control unit 1170 determines whether the leading edge of the sheet reaches the fixing nip N. If the leading edge of the sheet reaches the fixing nip N (YES in step S124), then in step S125, the control unit 1170 controls the operation of the first shutter drive motor 31 to move the first shutter 17 to the open position so that the sheet is sucked against the first conveyance belt 11. In the present exemplary embodiment, the control unit 1170 determines whether the leading edge of the sheet reaches the fixing nip N, as described below. Specifically, the control unit 1170 receives a signal indicating that the leading edge of the sheet is detected from the sheet leading edge detection sensor 26. The control unit 1170 receives the signal from the sheet leading edge detection sensor 26 and the timer 666 measures whether a predetermined time interval required by the leading edge of the sheet reaching the fixing nip N passes. Thus, the control unit 1170 determines whether the leading edge of the sheet reaches the fixing nip N.

Figure 18A:
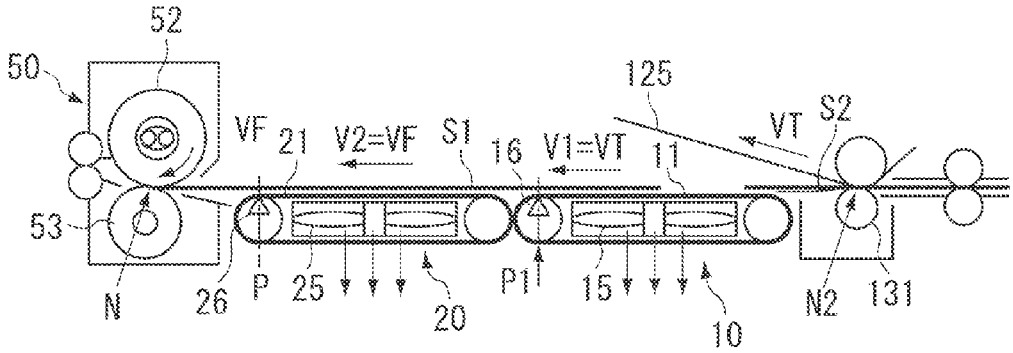
FIGS. 18A and 18B illustrate schematic diagrams illustrating operation in a case where the large-size sheet is conveyed in the mode in which the fixing speed is higher than the transfer speed in the second exemplary embodiment.

The leading edge of the sheet is nipped by the fixing nip N and then the sheet nipped by the fixing nip N is sucked against the first conveyance belt 11 rotated at the first speed lower than the fixing speed (refer to FIG. 18A). Because a nipping pressure is high at the fixing nip N, the conveyance force of the fixing unit 50 is greater than that of the first conveyance belt 11. Even if the fixing nip N is subjected to a back tension from the first conveyance belt 11 rotated at the first speed lower than the fixing speed, the fixing unit 50 can stably convey the sheet at the fixing speed VF, so that a defective fixing is not caused.

The reason the sheet is sucked against the first conveyance belt 11 in a state where the leading edge of the sheet 51 is nipped by the fixing nip N and the trailing edge of the sheet 51 lies on the second conveyance belt 21 is described below. The reason is that the leading edge of the succeeding sheet S2 can be caused to reach the first conveyance belt 11 while the preceding sheet is being conveyed by the fixing nip N (refer to FIG. 18A). In other words, the succeeding sheet S2 nipped by the secondary transfer nip N2 is conveyed by the first conveyance belt 11 which performs the suction of the sheet and is set to the first speed at which the sheet advancing from the transfer nip N2 is received and conveyed, so that the succeeding sheet S2 can be stably conveyed and a defective transfer is not caused. Thereby, sheets can be conveyed with the distance between continuous sheets shortened to provide the image forming apparatus high in productivity.

In step S126, the control unit 1170 determines whether the leading edge of the succeeding sheet S2 reaches the upstream detection position P1 based on the signal from the upstream sheet leading edge detection sensor 16. If the leading edge of the succeeding sheet S2 reaches the upstream detection position P1 (YES in step S126), then in step S127, the control unit 1170 controls the operation of the second shutter drive motor 30 to move the second shutter 27 to the closed position so that the sheet is not sucked against the second conveyance belt 21.

The reason the sheet is not sucked against the second conveyance belt 21 in a state where the leading edge of the preceding sheet is nipped by the fixing nip N and a part of the preceding sheet lies on the second conveyance belt 21 (the first suction state) is that an auxiliary transfer is sufficient for the function required by the second conveyance belt 21 after the leading edge of the sheet is nipped by the fixing nip N. In other words, the nipping pressure is high in the fixing nip N and the sheet is nipped by the fixing nip N and conveyed at the fixing speed VF, so that the defective fixing is not caused.

Thus, the reason the sheet is not sucked against the second conveyance belt 21 in a state where the trailing edge of the sheet nipped by the fixing nip N lies on the second conveyance belt 21 is that the leading edge of the succeeding sheet S2 can be caused to reach the second conveyance belt 21 while the preceding sheet S1 is being conveyed by the fixing nip N. Thereby, sheets can be conveyed with the distance between continuous sheets shortened to provide the image forming apparatus high in productivity. Although the trailing edge of the succeeding sheet S2 is on the secondary transfer nip N2 and the leading edge of the succeeding sheet S2 lies on the second conveyance belt 21, the sheet is not sucked against the second conveyance belt 21 to allow the succeeding sheet S2 to be stably conveyed by the first conveyance belt 11, preventing the defective transfer from being caused.

In step S128, the control unit 1170 determines whether the job is ended. If the job is not ended (NO in step S128), the processing returns to step S122. If the job is ended (YES in step S128), the processing returns to step S103 in FIG. 15 and ends.

Thus, the decrease of the length of the first and second conveyance belts 11 and 21 in the conveyance direction can provide a downsized apparatus. Even if the fixing speed VF is higher than the transfer speed VT, the conveyance of the sheet with the state of suction of the sheet against the first and second conveyance belts 11 and 21 changed realizes a stable conveyance of the sheet. The change of the state of suction of the sheet against the first and second conveyance belts 11 and 21 enables the sheet to be conveyed with the distance between the trailing edge of the preceding sheet S1 and the leading edge of the succeeding sheet S2 reduced.

Figure 15:
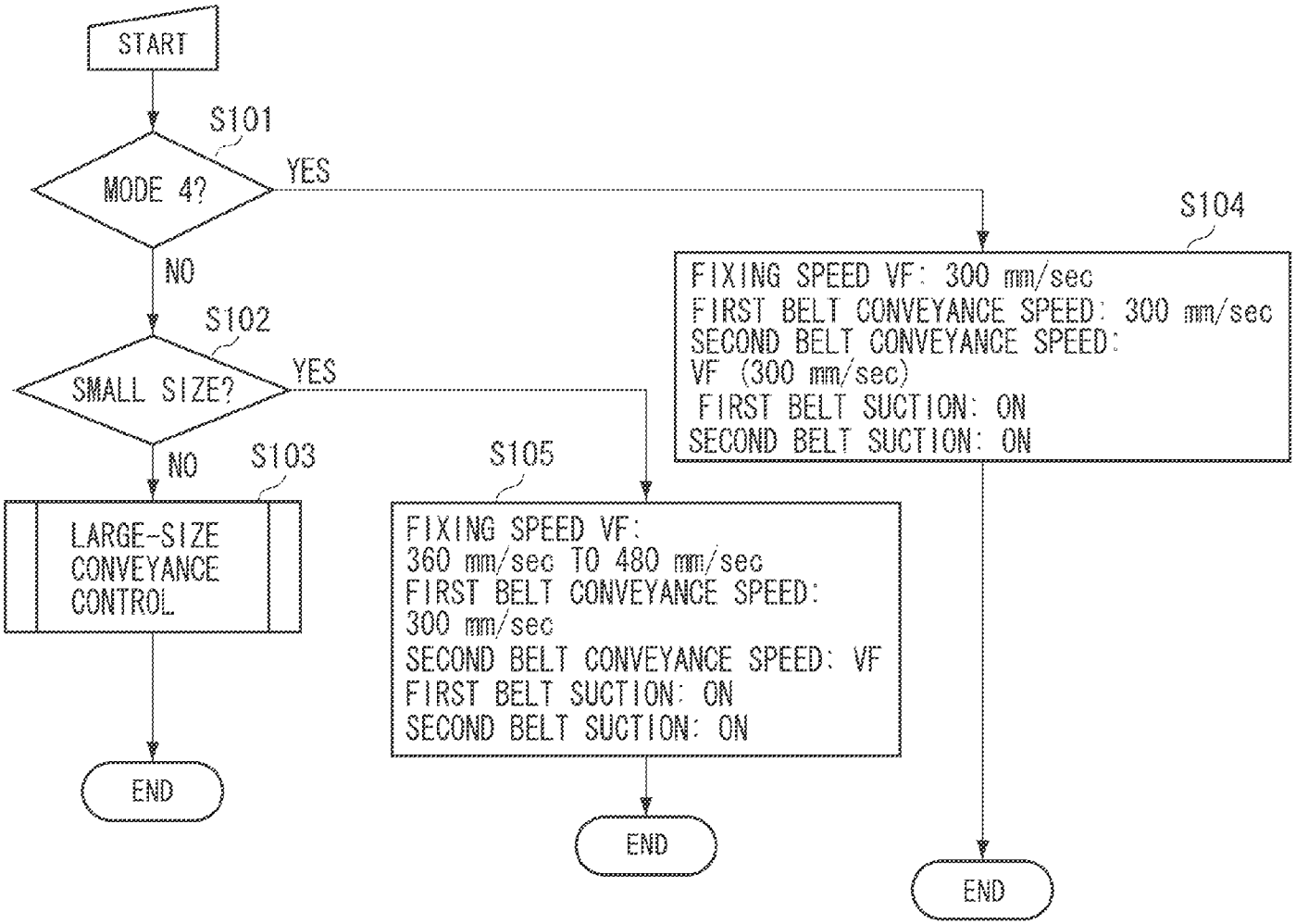
FIG. 15 is a flow chart illustrating the operation of the image forming apparatus according to the second exemplary embodiment.

In FIG. 15, if the control unit 1170 determines that the mode is in the mode 4 (YES in step S101), i.e., if the control unit 1170 determines that the fixing speed is equal to the transfer speed, the processing proceeds to step S104. In step S104, the control unit 1170 controls the first and second shutter drive motors 31 and 30 so that the suction operation of the sheet is performed in the first and second belt conveyance units 10 and 20. The control unit 1170 controls the first conveyance belt drive motor 14 so that the conveyance speed of the first belt conveyance unit 10 becomes equal to the first speed (300 mm/sec equal to the transfer speed, in the present exemplary embodiment). The control unit 1170 controls the second conveyance belt drive motor 24 so that the conveyance speed of the second belt conveyance unit 20 becomes equal to the first speed (300 mm/sec equal to the transfer speed, in the present exemplary embodiment). The sheet is continuously conveyed as it is. At this point, the conveyance state is similar to the one in the first exemplary embodiment illustrated in FIGS. 10A and 10B, so that the description thereof is omitted herein.

If the mode is not the mode 4 (i.e., if the fixing speed is higher than the transfer speed) (NO in step S101) and the sheet is of a small-sized (YES in step S102), the processing proceeds to step S105. In step S105, the control unit 1170 controls the first and second shutter drive motors 31 and 30 so that the suction operation of the sheet is performed in the first and second belt conveyance units 10 and 20. The control unit 1170 controls the first conveyance belt drive motor 14 so that the conveyance speed of the first belt conveyance unit 10 becomes equal to the first speed (300 mm/sec equal to the transfer speed). The control unit 1170 controls the second conveyance belt drive motor 24 so that the conveyance speed of the second belt conveyance unit 20 becomes equal to the second speed (equal to the fixing speed VF). The sheet is continuously conveyed as it is. At this point, the conveyance state is similar to the one in the first exemplary embodiment illustrated in FIGS. 9A to 9D, so that the description thereof is omitted herein.

In the above exemplary embodiments, the first shutter 17 lying in the closed position on the first belt conveyance unit 10 substantially completely covers the opening between the first suction fan 15 and the first conveyance belt 11. The second shutter 27 lying in the closed position substantially completely covers the opening. However, in the large-size conveyance control, while the toner image is being transferred to the sheet, the first and second suction devices have only to be operated so that the sheet slides on the second conveyance belt 21 by making greater the conveyance force of the first conveyance belt 11 than that of the second conveyance belt 21. When the transfer of the toner image to the sheet is completed and the sheet is caused to enter the fixing nip N, the first and second suction devices have only to be operated so that the sheet slides on the first conveyance belt 11 by making greater the conveyance force of the second conveyance belt 21 than that of the first conveyance belt 11. For example, the first shutter 17 may half cover the opening in the closed position. The second shutter 27 of the second belt conveyance unit 20 may half cover the opening in the closed position.

In the second exemplary embodiment, it is exemplified that the state of suction of the sheet is changed using the shutter in the first and second belt conveyance units 10 and 20. However, the state of suction of the sheet may be changed by controlling the rotation of the first and second suction fans 15 and 25 in the first and second belt conveyance units 10 and 20. In the large-size conveyance control, while the toner image is being transferred to the sheet, for example, the first suction fan 15 is rotated at top speed and the second suction fan 25 is stopped (or rotated at half-top speed). When the transfer of the toner image to the sheet is completed and the sheet is caused to enter the fixing nip N, the second suction fan 25 is rotated at top speed and the first suction fan 15 is stopped or rotated at half-top speed.

In the large-size conveyance control, the control unit 1170 determines the timing at which the first suction state is changed to the second suction state in the first and second belt conveyance units 10 and 20 depending on whether the leading edge of the sheet is detected by the sheet leading edge detection sensor 26. However, the timing at which the first suction state is changed to the second suction state has only to be fixed after the trailing edge of the sheet to be conveyed passes the secondary transfer nip N2, so that the present invention is not limited to the above configuration. For example, a sensor for detecting the sheet is provided near the registration roller 115. A signal is received from the sensor and then the timer 666 measures whether the time required for the trailing edge of the sheet passing the secondary transfer nip N2 elapses. Thus, the control unit 170 determines that the trailing edge of the sheet passes the secondary transfer nip N2. Alternatively, a sensor for detecting that the trailing edge of the sheet passes the transfer nip N2 may be provided between the transfer nip N2 and the first conveyance belt 11 and the suction state may be changed from the first suction state to the second suction state based on the signal of the sensor.

Similarly, in the large-size conveyance control, although it is exemplified that the suction operation in the second belt conveyance unit 20 is stopped and the suction state is returned to the first suction state at the timing at which the leading edge of the succeeding sheet is detected by the upstream leading edge detection sensor 16, the present invention is not limited to the above configuration. The timing at which the suction state of the first and second belt conveyance units 10 and 20 is returned to the first suction state may be earlier than the timing at which the succeeding sheet S2 reaches the second conveyance belt 21. For example, a sensor for detecting the sheet is provided near the registration roller 115, the suction operation in the second belt conveyance unit 20 is stopped and the suction state may be returned to the first suction state at the timing earlier than the timing at which the succeeding sheet S2 reaches the second conveyance belt 21 based on a signal from the sensor.

The second exemplary embodiment described above achieves the following effects.

(1) The fixing speed VF is changed according to the type and grammage of the sheet S. For this reason, the fixing unit can provide the sheet with an appropriate quantity of heat according to the type of the sheet S with the temperature of the fixing unit kept at a constant regulated temperature.

(2) The first and second belt conveyance units 10 and 20 arranged in the conveyance direction are provided between the secondary transfer nip N2 and the fixing nip N. The conveyance speed V1 of the first belt conveyance unit 10 is taken as the first speed at which the sheet advancing from the transfer nip N2 is received. The conveyance speed V2 of the second belt conveyance unit 20 is changed according to the fixing speed VF. Therefore, the sheet can be conveyed with the transfer speed VT kept constant irrespective of the setting value of the fixing speed VF which is changed according to the type and grammage of the sheet.

(3) Even if the large-sized sheet is conveyed in a mode in which the fixing speed VF is higher than the transfer speed, the sheet can be stably conveyed with a high productivity using the conveyance belt short in length in the conveyance direction.

More specifically, while the sheet to which the toner image is transferred at the secondary transfer nip N2 is being conveyed, the sheet is caused to slide on the second conveyance belt 21 by making greater the conveyance force of the first conveyance belt 11 than that of the second conveyance belt 21 (the first suction state). Accordingly, the sheet S which bridges the first and second conveyance belts 11 and 21 and to which the toner image is being transferred can be conveyed at the first speed, so that the toner image can be satisfactorily transferred to the sheet.

The conveyance force of the second conveyance belt 21 is made greater than the first conveyance belt 11 after the trailing edge of the sheet passes the secondary transfer nip N2 to slide the sheet on the first conveyance belt 11 (the second suction state). The conveyance speed of the sheet S which bridges the first and second conveyance belts 11 and 21 to which the transfer of the toner image is finished can be taken as the second speed. The leading edge of the sheet S which bridges the first and second conveyance belts 11 and 21 can be caused to reach the fixing nip N while being conveyed at the second speed.

Thus, the apparatus can be downsized by making shorter the length between the transfer nip N2 and the upstream end of the second conveyance belt 21 and between the downstream end of the first conveyance belt 11 and the fixing nip N than that of the maximum sheet. The apparatus can be downsized, and at the same time, the sheet can be conveyed at the first speed while the toner image is being transferred and stably conveyed at the high second speed after the transfer is finished.

The operation of the first suction device is controlled so that the sheet is sucked against the first conveyance belt 11 in a state where the tailing edge of the sheet still lies on the first conveyance belt 11 after the leading edge of the preceding sheet reaches the fixing nip N (refer to FIG. 18A). This control allows the first conveyance belt 11 to stably transfer the succeeding sheet sent from the secondary transfer nip N2 at the first speed even in a state where the trailing edge of the preceding sheet conveyed by the fixing nip N lies on the first conveyance belt 11. Consequently, the toner image is satisfactorily transferred to the succeeding sheet, and at the same time, the distance between the continuously conveyed sheets is decreased to allow the improvement of productivity.

Figure 18B:
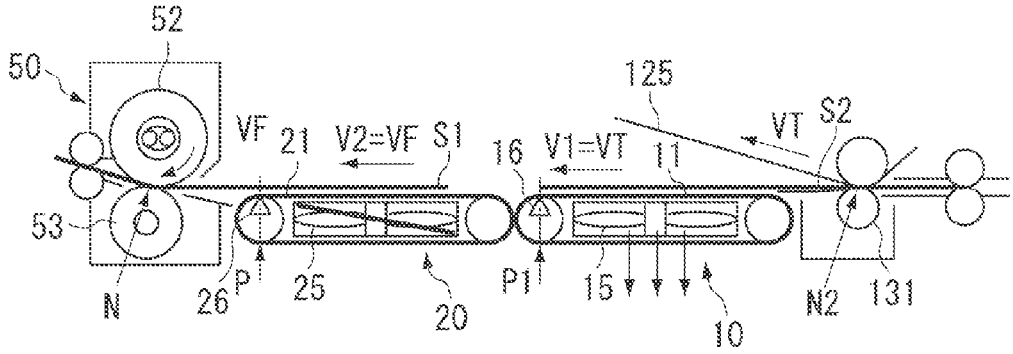

The control unit 170 performs control so that the suction state is changed to the first suction state in a state where the tailing edge of the preceding sheet still lies on the second conveyance belt 21 after the leading edge of the preceding sheet reaches the fixing nip N and before the succeeding sheet S2 reaches the second conveyance belt 21 (refer to FIG. 18B). In other words, their respective suction states are changed so that the conveyance force of the first belt conveyance unit 10 can be made greater than that of the second belt conveyance unit 20. This control allows the stable conveyance of the succeeding sheet sent from the secondary transfer nip N2 at the first speed with the succeeding sheet bridging the first and second conveyance belts 11 and 21 even in a state where the trailing edge of the preceding sheet lies on the second conveyance belt 21. Consequently, the toner image is satisfactorily transferred to the succeeding sheet, and at the same time, the distance between the continuously conveyed sheets is decreased to allow the improvement of productivity.

As described above, in the image forming apparatus of the present exemplary embodiment, the apparatus is small, and at the same time, the sheet can be smoothly conveyed with the distance between the tailing edge of the preceding sheet and the leading edge of the succeeding sheet being small even if the fixing speed VF is higher than the transfer speed VT.

(4) When the sheet to which the toner image has been already transferred is conveyed with the sheet bridging the first and second conveyance belts 11 and 21, the sheet is conveyed while being pulled by the second conveyance belt at a speed higher than the transfer speed so that the trailing edge of the sheet slides on the first conveyance belt 11. Therefore, the speed of the sheet is changed to a high speed earlier than the timing at which the trailing edge of the sheet leaves the downstream end of the first conveyance belt 11. Accordingly, the time required for the sheet advancing from the transfer nip N2 reaching the fixing nip N is short to improve productivity.

(5) The distance between the secondary transfer nip N2 and the fixing nip N is longer than the length of a sheet which is conveyable and maximum in size. Therefore, as illustrated in FIG. 10B, for example, after the tailing edge of the sheet S1 carrying the toner image yet to be fixed leaves the secondary transfer nip N2, the leading edge of the sheet S1 reaches the fixing nip N. Even if a shock occurs when thick paper plunges into the fixing nip N, the tailing edge of the sheet S1 leaves the secondary transfer nip N2, so that image defectiveness can be minimized.

(6) The shutter 17 is opened or closed to cause the suction fan 15 of the first belt conveyance unit 10 to suck the sheet or not and the shutter 27 is also used in the second belt conveyance unit 20. This configuration further achieves the following effect. The suction state can be changed by the suction fan with a good response.

The configuration is inexpensive in which the rotation operation of the first and second suction fans is controlled without the use of the shutters 17 and 27 to change the suction state where the sheet is sucked against the first and second conveyance belts 11 and 21 because other devices do not need to be added for the change of the suction state.

Although the first and second exemplary embodiments describe an example of the image forming apparatus for forming a full-color toner image on a sheet, the exemplary embodiments can be applied to an image forming apparatus for forming also a monochrome toner image thereon.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-227527 filed Oct. 7, 2010, No. 2010-227528 filed Oct. 7, 2010, and No. 2010-227529 filed Oct. 7, 2010, which are hereby incorporated by reference herein in their entirety.

What is claimed is:

1. An image forming apparatus comprising:

a transfer nip configured to transfer a toner image to a sheet conveyed at a transfer speed;

a first conveyance belt configured to convey the sheet to which the toner image is transferred at the transfer nip;

a second conveyance belt provided downstream of the first conveyance belt in a conveyance direction in which the sheet is conveyed and configured to convey the sheet;

a fixing nip provided downstream of the second conveyance belt in the conveyance direction and configured to fix the toner image to the sheet while conveying the sheet;

a fixing drive unit configured to drive the fixing nip so that the fixing nip conveys the sheet at a speed that is higher than the transfer speed in a high speed fixing mode in which the fixing nip fixes the toner image to the sheet while conveying the sheet at the speed that is higher than the transfer speed; and a control unit configured to perform control so that a circumferential speed of the second conveyance belt is changed from a first speed at which the sheet advances from the transfer nip to a second speed at which a leading edge of the sheet enters the fixing nip and which is higher than the first speed after a trailing edge of the sheet, conveyed by the first conveyance belt whose circumferential speed is set to the first speed and the second conveyance belt whose circumferential speed is set to the first speed, passes the transfer nip and before the leading edge of the sheet reaches the fixing nip in the high speed fixing mode and in response to a length of the conveyed sheet in the conveyance direction being longer than a length from the transfer nip to an upstream end of the second conveyance belt, wherein, after the circumferential speed of the second conveyance belt is changed to the second speed, the sheet sucked against the second conveyance belt is conveyed by the second conveyance belt while sliding on the first conveyance belt.

2. The image forming apparatus according to claim 1, wherein, in the high speed fixing mode, the leading edge of a succeeding sheet advancing from the transfer nip in succession to a preceding sheet reaches the first conveyance belt with the preceding sheet being on the first and second conveyance belts.

3. The image forming apparatus according to claim 2, wherein, in the high speed fixing mode, the control unit changes the circumferential speed of the second conveyance belt to the first speed after a leading edge of the preceding sheet conveyed by the second conveyance belt reaches the fixing nip, when the preceding sheet lies on the second conveyance belt, and before the succeeding sheet reaches the second conveyance belt.

4. The image forming apparatus according to claim 1, further comprising:

a first suction device configured to suck the sheet against a circumferential surface of the first conveyance belt; and a second suction device configured to suck the sheet against a circumferential surface of the second conveyance belt, wherein a force by which the second suction device sucks the sheet against the circumferential surface of the second conveyance belt is made greater than a force by which the first suction device sucks the sheet against the circumferential surface of the first conveyance belt to cause the second conveyance belt to pull and convey the sheet so that the sheet slides on the first conveyance belt when the leading edge of the sheet reaches the fixing nip.

5. The image forming apparatus according to claim 1, further comprising:

a first suction device configured to suck the sheet against a circumferential surface of the first conveyance belt; and a second suction device configured to suck the sheet against a circumferential surface of the second conveyance belt, wherein a friction coefficient of the circumferential surface of the second conveyance belt is made greater than a friction coefficient of the circumferential surface of the first conveyance belt to cause the second conveyance belt against which the sheet is sucked by the second suction device to pull and convey the sheet so that the sheet slides on the first conveyance belt against which the sheet is sucked by the first suction device when the leading edge of the sheet reaches the fixing nip.

6. The image forming apparatus according to claim 1, wherein, in response to a length of the conveyed sheet in the conveyance direction being shorter than a length from the transfer nip to an upstream end of the second conveyance belt and shorter than a length from a downstream end of the first conveyance belt to the fixing nip, the sheet advancing from the transfer nip to the fixing nip is conveyed with the circumferential speed of the first conveyance belt set to the first speed and the circumferential speed of the second conveyance belt set to the second speed and the sheet lying on the first and second conveyance belts is pulled and conveyed by the second conveyance belt while sliding on the first conveyance belt at a speed that is higher than the first speed.

7. The image forming apparatus according to claim 1, wherein, in the high speed fixing mode and in response to a length of the conveyed sheet in the conveyance direction being longer than a length from the transfer nip to an upstream end of the second conveyance belt and longer than a length from a downstream end of the first conveyance belt to the fixing nip, the control unit performs control so that the circumferential speed of the second conveyance belt is changed to the second speed after a trailing edge of the sheet, conveyed by the first conveyance belt whose circumferential speed is set to the first speed and the second conveyance belt whose circumferential speed is set to the first speed, passes the transfer nip and before the leading edge of the sheet reaches the fixing nip, and, after the circumferential speed of the second conveyance belt is changed to the second speed, the leading edge of the sheet reaches the fixing nip with the sheet sucked against the second conveyance belt pulled and conveyed by the second conveyance belt while sliding on the first conveyance belt.

8. An image forming apparatus comprising:

a transfer nip configured to transfer a toner image to a sheet conveyed at a transfer speed;

a first conveyance belt configured to convey the sheet to which the toner image is transferred at the transfer nip;

a second conveyance belt provided downstream of the first conveyance belt in a conveyance direction in which the sheet is conveyed and configured to convey the sheet;

a fixing nip provided downstream of the second conveyance belt in the conveyance direction and configured to fix the toner image to the sheet while conveying the sheet;

a drive unit configured to drive the fixing nip so that the fixing nip conveys the sheet at a speed that is higher than the transfer speed in a high speed fixing mode in which the fixing nip fixes the toner image to the sheet while conveying the sheet at the speed that is higher than the transfer speed;

a suction unit provided for each of the first and second conveyance belts and configured to suck the sheet; and a control unit configured to control an operation of the suction unit for sucking the sheet against each of the first and second conveyance belts, wherein, in the high speed fixing mode and in response to a length of the conveyed sheet in the conveyance direction being longer than a length from the transfer nip to an upstream end of the second conveyance belt, a circumferential speed of the first conveyance belt is set to a first speed at which the sheet advances from the transfer nip and a circumferential speed of the second conveyance belt is set to a second speed at which a leading edge of the sheet enters the fixing nip and which is higher than the first speed and the control unit controls the suction unit so that the sheet is sucked against the first conveyance belt and slides on the second conveyance belt in a state that the sheet to which the toner image is transferred by the transfer nip is being conveyed by the first conveyance belt and controls the suction unit to cause the second conveyance belt to pull and convey the sheet so that the sheet slides on the first conveyance belt after a trailing edge of the sheet, conveyed by the first conveyance belt whose circumferential speed is set to the first speed, passes the transfer nip.

9. The image forming apparatus according to claim 8, wherein, in the high speed fixing mode, the control unit controls the suction unit so that the sheet is sucked against the first conveyance belt and the sheet is not sucked against the second conveyance belt until a trailing edge of the conveyed sheet passes the transfer nip, and controls the suction unit so that the sheet is sucked against the second conveyance belt and the sheet is not sucked against the first conveyance belt after the trailing edge of the conveyed sheet passes the transfer nip and before the leading edge of the sheet reaches the fixing nip.

10. The image forming apparatus according to claim 9, wherein the control unit controls the operation of the suction unit so that the sheet is not sucked against the second conveyance belt when the leading edge of a preceding sheet reaches the fixing nip and lies on the second conveyance belt and a succeeding sheet conveyed in succession to the preceding sheet is conveyed onto the second conveyance belt by the first conveyance belt while the preceding sheet is conveyed by the fixing nip and after the preceding sheet is not sucked against the second conveyance belt.

11. The image forming apparatus according to claim 8, wherein the suction unit includes a first suction device configured to suck the sheet against the first conveyance belt and a second suction device configured to suck the sheet against the second conveyance belt, wherein the first suction device includes a first fan and a first shutter configured to open and close between the first fan and the first conveyance belt, wherein the second suction device includes a second fan and a second shutter configured to open and close between the second fan and the second conveyance belt, and wherein the control unit opens and closes the first and second shutters to control the operation of the suction unit for sucking the sheet against the first and second conveyance belts.

12. The image forming apparatus according to claim 8, wherein, in the high speed fixing mode and in response to a length of the conveyed sheet in the conveyance direction being longer than a length from the transfer nip to an upstream end of the second conveyance belt and longer than a length from a downstream end of the first conveyance belt to the fixing nip, the circumferential speed of the first conveyance belt is set to the first speed and the circumferential speed of the second conveyance belt is set to the second speed and the control unit controls the suction unit so that the sheet is sucked against the first conveyance belt and slides on the second conveyance belt in a state that the sheet to which the toner image is transferred by the transfer nip is being conveyed by the first conveyance belt and controls the suction unit to cause the second conveyance belt to pull and convey the sheet so that the sheet slides on the first conveyance belt when the leading edge of the sheet reaches the fixing nip.

13. An image forming apparatus comprising:

a transfer nip configured to transfer a toner image to a sheet conveyed at a transfer speed;

a first conveyance belt configured to convey the sheet to which the toner image is transferred at the transfer nip;

a second conveyance belt provided downstream of the first conveyance belt in a conveyance direction in which the sheet is conveyed and configured to convey the sheet;

a fixing nip provided downstream of the second conveyance belt in the conveyance direction and configured to fix the toner image to the sheet while conveying the sheet; and a control unit configured to perform control so that a circumferential speed of the second conveyance belt is changed from a first speed at which the sheet advances from the transfer nip to a second speed at which a leading edge of the sheet enters the fixing nip and which is higher than the first speed after a trailing edge of the sheet, conveyed by the first conveyance belt whose circumferential speed is set to the first speed and the second conveyance belt whose circumferential speed is set to the first speed, passes the transfer nip and before the leading edge of the sheet reaches the fixing nip in response to a length of the conveyed sheet in the conveyance direction being longer than a length from the transfer nip to an upstream end of the second conveyance belt, wherein, after the circumferential speed of the second conveyance belt is changed to the second speed, the sheet sucked against the second conveyance belt is conveyed by the second conveyance belt while sliding on the first conveyance belt.

14. The image forming apparatus according to claim 13, wherein the leading edge of a succeeding sheet advancing from the transfer nip in succession to a preceding sheet reaches the first conveyance belt with the preceding sheet being on the first and second conveyance belts.

15. The image forming apparatus according to claim 13, further comprising:

a first suction device configured to suck the sheet against a circumferential surface of the first conveyance belt; and a second suction device configured to suck the sheet against a circumferential surface of the second conveyance belt, wherein a force by which the second suction device sucks the sheet against the circumferential surface of the second conveyance belt is made greater than a force by which the first suction device sucks the sheet against the circumferential surface of the first conveyance belt to cause the second conveyance belt to pull and convey the sheet so that the sheet slides on the first conveyance belt when the leading edge of the sheet reaches the fixing nip.

16. The image forming apparatus according to claim 13, further comprising:

a first suction device configured to suck the sheet against a circumferential surface of the first conveyance belt; and a second suction device configured to suck the sheet against a circumferential surface of the second conveyance belt, wherein a friction coefficient of the circumferential surface of the second conveyance belt is made greater than a friction coefficient of the circumferential surface of the first conveyance belt to cause the second conveyance belt against which the sheet is sucked by the second suction device to pull and convey the sheet so that the sheet slides on the first conveyance belt against which the sheet is sucked by the first suction device when the leading edge of the sheet reaches the fixing nip.

17. The image forming apparatus according to claim 13, wherein, in response to a length of the conveyed sheet in the conveyance direction being shorter than a length from the transfer nip to an upstream end of the second conveyance belt and shorter than a length from a downstream end of the first conveyance belt to the fixing nip, the sheet advancing from the transfer nip to the fixing nip is conveyed with the circumferential speed of the first conveyance belt set to the first speed and the circumferential speed of the second conveyance belt set to the second speed and the sheet lying on the first and second conveyance belts is pulled and conveyed by the second conveyance belt while sliding on the first conveyance belt at a speed that is higher than the first speed.

18. The image forming apparatus according to claim 13, wherein, in response to a length of the conveyed sheet in the conveyance direction being longer than a length from the transfer nip to an upstream end of the second conveyance belt and longer than a length from a downstream end of the first conveyance belt to the fixing nip, the control unit performs control so that the circumferential speed of the second conveyance belt is changed to the second speed after a trailing edge of the sheet, conveyed by the first conveyance belt whose circumferential speed is set to the first speed and the second conveyance belt whose circumferential speed is set to the first speed, passes the transfer nip and before the leading edge of the sheet reaches the fixing nip, and, after the circumferential speed of the second conveyance belt is changed to the second speed, the leading edge of the sheet reaches the fixing nip with the sheet sucked against the second conveyance belt pulled and conveyed by the second conveyance belt while sliding on the first conveyance belt.

19. An image forming apparatus comprising:

a transfer nip configured to transfer a toner image to a sheet conveyed at a transfer speed;

a first conveyance belt configured to convey the sheet to which the toner image is transferred at the transfer nip;

a second conveyance belt provided downstream of the first conveyance belt in a conveyance direction in which the sheet is conveyed and configured to convey the sheet;

a fixing nip provided downstream of the second conveyance belt in the conveyance direction and configured to fix the toner image to the sheet while conveying the sheet;

a suction unit provided for each of the first and second conveyance belts and configured to suck the sheet; and a control unit configured to control an operation of the suction unit for sucking the sheet against each of the first and second conveyance belts, wherein, in response to a length of the conveyed sheet in the conveyance direction being longer than a length from the transfer nip to an upstream end of the second conveyance belt, a circumferential speed of the first conveyance belt is set to a first speed at which the sheet advances from the transfer nip and a circumferential speed of the second conveyance belt is set to a second speed at which a leading edge of the sheet enters the fixing nip and which is higher than the first speed and the control unit controls the suction unit so that the sheet is sucked against the first conveyance belt and slides on the second conveyance belt in a state that the sheet to which the toner image is transferred by the transfer nip is being conveyed by the first conveyance belt and controls the suction unit to cause the second conveyance belt to pull and convey the sheet so that the sheet slides on the first conveyance belt after a trailing edge of the sheet, conveyed by the first conveyance belt whose circumferential speed is set to the first speed, passes the transfer nip.

20. The image forming apparatus according to claim 19, wherein the control unit controls the suction unit so that the sheet is sucked against the first conveyance belt and the sheet is not sucked against the second conveyance belt until a trailing edge of the conveyed sheet passes the transfer nip, and controls the suction unit so that the sheet is sucked against the second conveyance belt and the sheet is not sucked against the first conveyance belt after the trailing edge of the conveyed sheet passes the transfer nip and before the leading edge of the sheet reaches the fixing nip.

21. The image forming apparatus according to claim 19, wherein the suction unit includes a first suction device configured to suck the sheet against the first conveyance belt and a second suction device configured to suck the sheet against the second conveyance belt, wherein the first suction device includes a first fan and a first shutter configured to open and close between the first fan and the first conveyance belt, wherein the second suction device includes a second fan and a second shutter configured to open and close between the second fan and the second conveyance belt, and wherein the control unit opens and closes the first and second shutters to control the operation of the suction unit for sucking the sheet against the first and second conveyance belts.

22. The image forming apparatus according to claim 19, wherein, in response to a length of the conveyed sheet in the conveyance direction being longer than a length from the transfer nip to an upstream end of the second conveyance belt and longer than a length from a downstream end of the first conveyance belt to the fixing nip, the circumferential speed of the first conveyance belt is set to the first speed and the circumferential speed of the second conveyance belt is set to the second speed and the control unit controls the suction unit so that the sheet is sucked against the first conveyance belt and slides on the second conveyance belt in a state that the sheet to which the toner image is transferred by the transfer nip is being conveyed by the first conveyance belt and controls the suction unit to cause the second conveyance belt to pull and convey the sheet so that the sheet slides on the first conveyance belt when the leading edge of the sheet reaches the fixing nip.

* * * * *